US009168462B2

(12) United States Patent
Jung

(10) Patent No.: US 9,168,462 B2
(45) Date of Patent: Oct. 27, 2015

(54) DOLL WITH DRESS THAT TRANSFORMS TO WINGS

(75) Inventor: Simon Jung, Alhambra, CA (US)

(73) Assignee: Mattel, Inc., El Segundo, CA (US)

( * ) Notice: Subject to any disclaimer, the term of this patent is extended or adjusted under 35 U.S.C. 154(b) by 1143 days.

(21) Appl. No.: 12/577,173

(22) Filed: Oct. 10, 2009

(65) Prior Publication Data

US 2010/0093254 A1 Apr. 15, 2010

Related U.S. Application Data

(60) Provisional application No. 61/195,896, filed on Oct. 10, 2008.

(51) Int. Cl.

| | |
|---|---|
| ***A63H 3/00*** | (2006.01) |
| ***A63H 3/20*** | (2006.01) |
| ***A63H 3/48*** | (2006.01) |
| ***A63H 33/00*** | (2006.01) |

(52) U.S. Cl.
CPC .. *A63H 3/20* (2013.01); *A63H 3/48* (2013.01); *A63H 33/003* (2013.01)

(58) Field of Classification Search
CPC ..... A63H 3/20; A63H 3/52; A63H 13/00
USPC ..... 446/268, 97, 98, 330, 354
See application file for complete search history.

(56) References Cited

U.S. PATENT DOCUMENTS

| | | | | |
|---|---|---|---|---|
| D56,667 | S | | 11/1920 | Haines |
| 1,396,766 | A | | 11/1921 | McClelland |
| 1,407,165 | A | | 2/1922 | Hamilton |
| 1,567,661 | A | | 12/1925 | Levaggi et al. |
| 1,966,986 | A | | 7/1934 | Martin |
| 2,380,175 | A | * | 7/1945 | Hawkey ..... 135/16 |
| 3,153,871 | A | | 10/1964 | Semba |
| 3,577,670 | A | | 5/1971 | Gutierrez |
| 3,724,125 | A | | 4/1973 | Goldfarb et al. |
| 4,107,873 | A | | 8/1978 | Bauer |
| D255,476 | S | | 6/1980 | Cox |
| 4,244,138 | A | | 1/1981 | Holahan et al. |
| 4,279,419 | A | | 7/1981 | Barnes et al. |
| 4,307,533 | A | | 12/1981 | Sims et al. |
| 4,512,690 | A | | 4/1985 | Johnson |
| 4,568,304 | A | | 2/1986 | Santa Maria |
| 4,571,206 | A | | 2/1986 | Mayer et al. |
| 4,575,349 | A | | 3/1986 | Piazza et al. |

(Continued)

FOREIGN PATENT DOCUMENTS

| | | | |
|---|---|---|---|
| GB | 2303077 | A | 2/1997 |
| JP | 01020879 | A | 1/1989 |

(Continued)

OTHER PUBLICATIONS

Barbie Wonder Fairy doll Instructions; 4 pages, (c) 2004.

(Continued)

*Primary Examiner* — Gene Kim
*Assistant Examiner* — Urszula M Cegielnik
(74) *Attorney, Agent, or Firm* — Edell, Shapiro & Finnan, LLC

(57) ABSTRACT

Interactive and reconfigurable toy dolls are disclosed. The toy dolls have one or more associated movable components that may be actuated through user manipulation so as to transform a doll's dress into wings.

20 Claims, 24 Drawing Sheets

(56) References Cited

U.S. PATENT DOCUMENTS

| | | | | | |
|---|---|---|---|---|---|
| 4,601,478 | A | | 7/1986 | Robertson et al. | |
| 4,610,639 | A | | 9/1986 | Piazza | |
| 4,639,233 | A | | 1/1987 | Brassfield | |
| 4,715,840 | A | | 12/1987 | Swift | |
| 4,718,877 | A | | 1/1988 | Girsch et al. | |
| 4,867,729 | A | | 9/1989 | Weinman et al. | |
| 4,921,459 | A | | 5/1990 | Cook et al. | |
| 4,995,846 | A | | 2/1991 | Mariol | |
| 5,015,209 | A | | 5/1991 | Ortiz | |
| D317,341 | S | | 6/1991 | Cardillo | |
| 5,149,289 | A | | 9/1992 | Edwards et al. | |
| 5,167,562 | A | | 12/1992 | Axtell | |
| 5,172,863 | A | | 12/1992 | Melone et al. | |
| 5,235,997 | A | * | 8/1993 | Good | 135/25.3 |
| 5,277,645 | A | | 1/1994 | Kelley et al. | |
| 5,310,378 | A | * | 5/1994 | Shannon | 446/268 |
| 5,328,400 | A | * | 7/1994 | Bass | 446/268 |
| 5,378,188 | A | | 1/1995 | Clark | |
| 5,525,086 | A | * | 6/1996 | Gentile et al. | 446/37 |
| 5,588,895 | A | * | 12/1996 | Larson | 446/98 |
| 5,651,717 | A | | 7/1997 | Hamilton et al. | |
| 5,803,787 | A | | 9/1998 | Kulchyski | |
| 5,868,598 | A | | 2/1999 | Dinovo | |
| D415,221 | S | | 10/1999 | Dial | |
| 5,964,638 | A | | 10/1999 | Emerson | |
| D417,707 | S | | 12/1999 | Gilford | |
| 6,012,962 | A | | 1/2000 | Arriola | |
| 6,086,446 | A | * | 7/2000 | Arriola | 446/72 |
| 6,152,799 | A | | 11/2000 | Arriola | |
| 6,200,190 | B1 | | 3/2001 | Reynolds | |
| 6,322,421 | B1 | * | 11/2001 | Hou | 446/330 |
| 6,450,855 | B1 | * | 9/2002 | Tang | 446/330 |
| 6,508,688 | B1 | | 1/2003 | Liu | |
| 6,962,518 | B2 | | 11/2005 | Wang | |
| 7,175,496 | B1 | | 2/2007 | Lund et al. | |
| D548,962 | S | | 8/2007 | Meyers | |
| 2005/0191936 | A1 | | 9/2005 | Marine et al. | |
| 2006/0148377 | A1 | | 7/2006 | Stubenfoll | |

FOREIGN PATENT DOCUMENTS

| | | | | |
|---|---|---|---|---|
| JP | 3-3389 | U | | 1/1991 |
| JP | 09187575 | A | | 7/1997 |
| JP | 11207047 | A | | 8/1999 |
| JP | 11333149 | A | | 12/1999 |
| WO | 9305857 | A1 | | 4/1993 |
| WO | WO 2007010264 | A2 | * | 1/2007 |

OTHER PUBLICATIONS

International Search Report and Written Opinion for PCT Application No. PCT/2009/060294, 6 pages.

* cited by examiner

DOLL WITH DRESS THAT TRANSFORMS TO WINGS

CROSS-REFERENCE TO RELATED APPLICATION

This application claims priority to and the benefit of U.S. Provisional Patent Application No. 61/195,896, filed Oct. 10, 2008, entitled "Doll With Dress That Transforms to Wings," the entire disclosure of which is incorporated herein by reference in its entirety.

FIELD OF THE INVENTION

The invention is directed generally to interactive toy dolls and, more particularly, to toy dolls with one or more associated movable components that may be actuated through user manipulation so as to transform a doll's dress into wings.

BACKGROUND OF THE INVENTION

Some conventional figures or dolls have movable components. Such figures or dolls typically have conventional movement of one or more parts. Some examples of transformable dolls and dolls with wing movement actuated by the user are disclosed in U.S. Pat. Nos. 4,568,304; 4,571,206; 5,149,289; and 5,588,895. The disclosures of all the above-referenced patents are incorporated herein by reference in their entirety for all purposes.

There is a need for a figure or doll that has a movable component that moves in a new manner or pattern. There is also a need for a figure or doll that has a component that transforms or is reconfigurable.

SUMMARY OF THE INVENTION

In one embodiment, a reconfigurable doll includes a body including a torso and at least one arm movably coupled to the torso, a movable portion coupled to the body, the movable portion being disposable in a first position proximate to the body in which the movable portion forms part of a dress for the body and in a second position spaced apart from the body in which the movable portion forms part of a wing for the body; and an actuator assembly coupled to the body, the actuator assembly being connected to the at least one arm and the movable portion, the actuator assembly being manipulatable by a user to move the movable portion from the first position to the second position and the at least one arm relative to the torso.

In one embodiment, the body of the doll includes a lower portion and the movable portion in its first position is proximate to the lower portion of the body. The at least one arm of the doll is movable substantially simultaneously with the movable portion. In addition, the at least one arm has an upper position and a lower position relative to the body, the at least one arm extending upwardly from the body in its upper position and being located proximate to the body in its lower position.

In one embodiment, the movable portion of the doll is a first movable portion and the doll includes a second movable portion coupled to the body, the second movable portion being disposable in its own first position proximate to the body in which the second movable portion forms part of the dress for the body and its own second position spaced apart from the body in which the second movable portion forms part of a wing for the body.

In one embodiment, the second movable portion is moved substantially simultaneously with the first movable portion. Alternatively or in addition, the first movable portion overlaps part of the second movable portion when the movable portions are in their first positions.

In one embodiment, each of the movable portions includes a support member with a proximal end coupled to the torso and an opposite, distal end, the distal ends of the support members crossing over each other when the movable portions are moved from their second positions to their first positions.

In another embodiment, the actuator assembly includes an actuator extending outwardly from the body, the actuator being manipulatable by a user to move the movable portion. The movable portion includes a support member that is pivotally coupled to the torso of the doll and a flexible member that is coupled to the support member. The support member includes a proximal end, a distal end, and a curved portion between the proximal end and the distal end, the proximal end being coupled to the body. The distal end extends outwardly away from the body when the movable portion is in its second position, and the curved portion extends around part of the torso of the body when the movable portion is in its first position.

In one embodiment, a reconfigurable doll includes a body including a torso and a lower portion, a movable member coupled to the body, the movable member being disposable in an upper position and in a lower position relative to the body, the movable member being spaced from the body and forming a wing-like structure in its upper position, the movable member being located proximate to the lower portion of the body and forming a dress-like structure in its lower position, and an actuator assembly coupled to the body, the actuator assembly being connected to the movable member in the torso of the body so that a user can manipulate the actuator assembly to move the movable member between its upper position and its lower position.

In one embodiment, the movable member is a first movable member, and the doll includes a second movable member coupled to the body and to the actuator assembly, the movable members collectively forming a dress when the movable members are in their lower positions and collectively forming a pair of wings when the movable members are in their upper positions, the movable members being moved substantially simultaneously between their upper positions and lower positions via the actuator assembly.

In one embodiment, the body includes a first arm and a second arm movably coupled to the torso, the actuator assembly being connected to the first arm and second arm so that a user can manipulate the first arm and second arm relative to the body substantially simultaneously when the first and second movable members are moved.

In another embodiment, the arms are moved from lower positions to upper positions substantially simultaneously when the movable members are moved from their lower positions to their upper positions.

In one embodiment, the actuator assembly includes an actuator and a drive mechanism coupled to the actuator, the drive mechanism being connected to the arms and to the movable members so that movement of the actuator results in movement of the arms and movable members relative to the body.

In one embodiment, the body includes a first arm and a second arm movably coupled to the torso, and the actuator assembly is connected to the first arm and second arm so that a user can manipulate the first arm and second arm relative to the body when the movable member is moved.

In one embodiment, a reconfigurable doll includes a body including a torso, a lower portion, and arms movably coupled to the torso, the arms being disposable in raised positions and in lowered positions relative to the body, movable members coupled to the body, the movable members being placeable in raised positions and in lowered positions relative to the body, the movable members being spaced from the body and forming a wing-like structures in their raised positions, the movable members being located proximate to the lower portion of the body and forming a dress-like structure in their lowered positions, and an actuator coupled to the arms and the movable members, the actuator being configured to move the movable members between their raised and lowered positions substantially simultaneously with the movement of the arms between their raised and lowered positions.

In one embodiment, each of the movable members includes a support member pivotally coupled to the body, the support members extending outwardly from the torso when the movable members are in their raised positions, the support members being located proximate to the lower portion of the body when the movable members are in their lowered positions, the support members crossing over each other when the movable members are in their lowered positions.

BRIEF DESCRIPTION OF THE DRAWINGS

Like reference numerals have been used to identify like elements throughout this disclosure.

DETAILED DESCRIPTION OF THE INVENTION

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, terms such as "first," "second," "third," etc., merely identify one of a number of portions, components and/or points of reference as disclosed herein, and do not limit the present invention to any particular configuration or orientation or any particular quantity of such elements.

FIGS. 1-6 illustrate different examples of a toy doll that may be configured to represent a human-like character, licensed character, copyrighted character, or any other suitable fantasy or real-life character. The terms "character," "figure," and "doll" can be used interchangeably herein. To simplify discussion, the features of doll 10 illustrated in FIGS.

1-2 that correspond to features of the examples illustrated in FIGS. 3-17 are given the same reference numbers.

Figure 2:
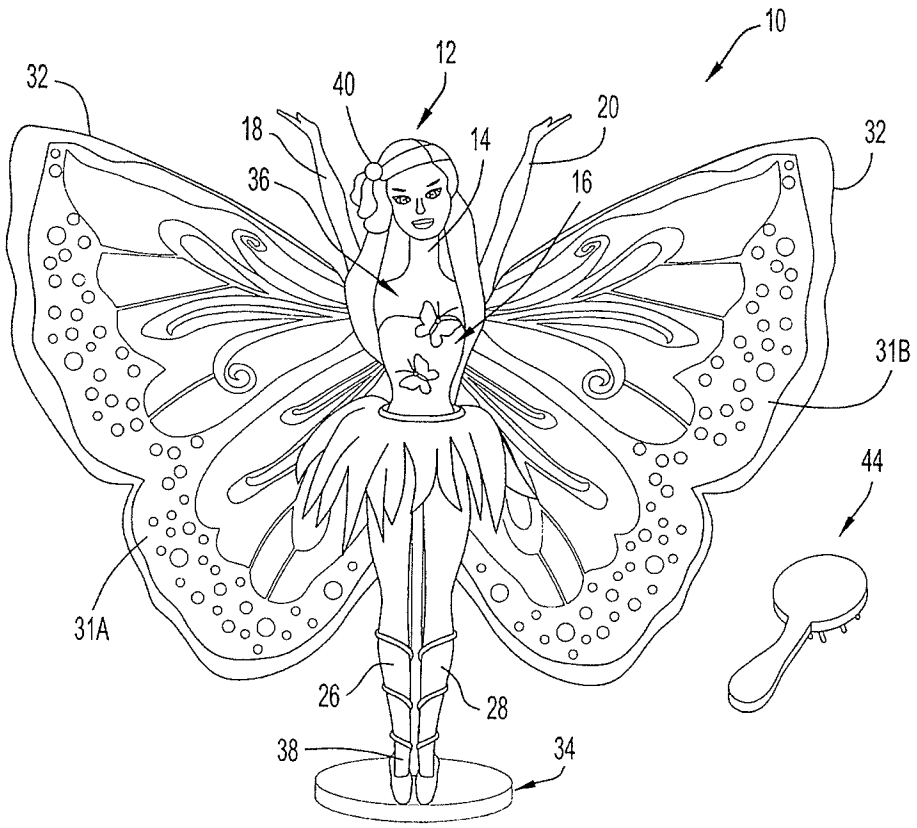
FIG. 2 illustrates a front view of the doll of FIG. 1 in a wings position or configuration when mounted on a stand.
Figure 1:
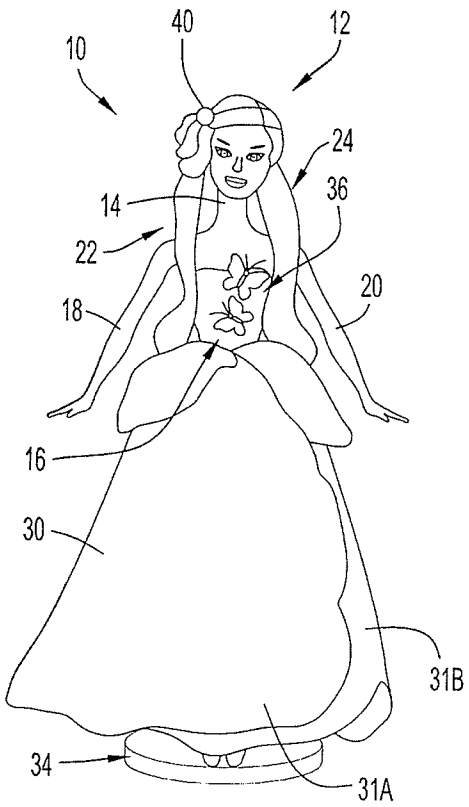
FIG. 1 illustrates a front view of an exemplary embodiment of a doll in a dress position or configuration when mounted on a stand.
Figure 4:
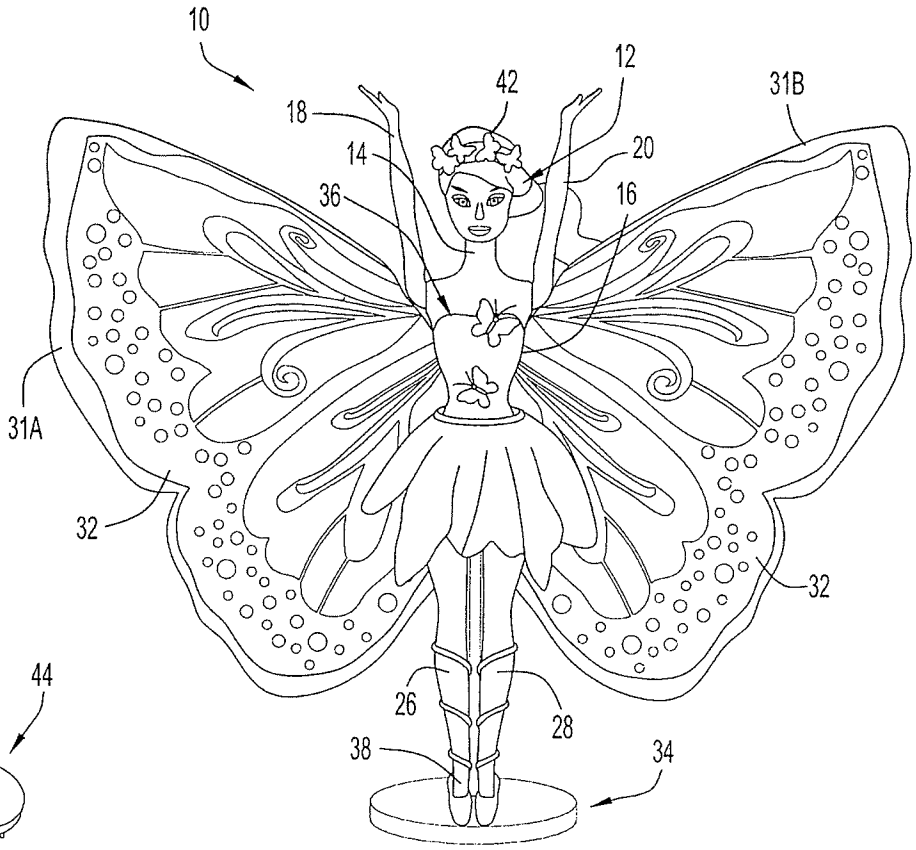
FIG. 4 illustrates a front view of the doll of FIG. 3 in a wings position or configuration when mounted on a stand.
Figure 3:
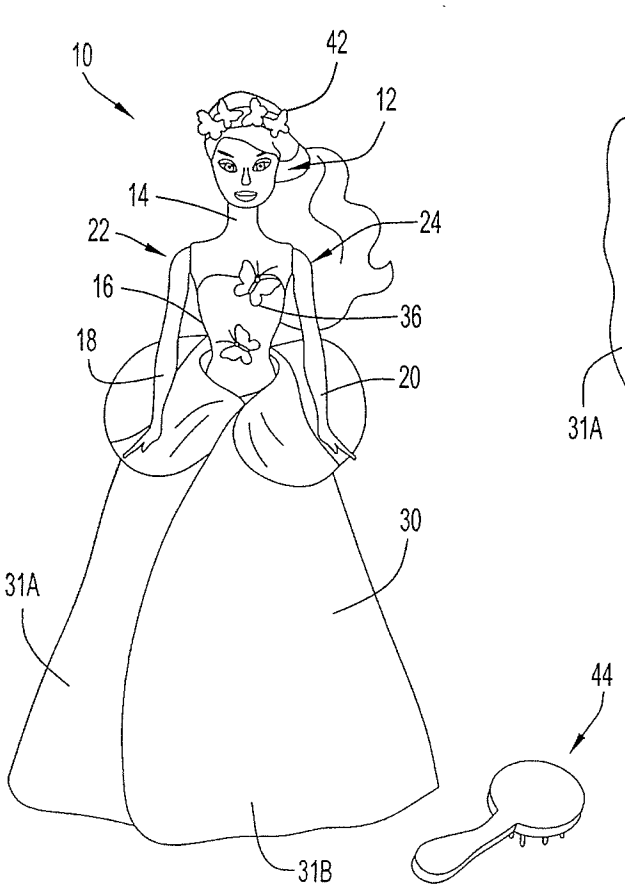
FIG. 3 illustrates a front view of another embodiment of a doll in a dress position or configuration when mounted on a stand.
Figure 6:
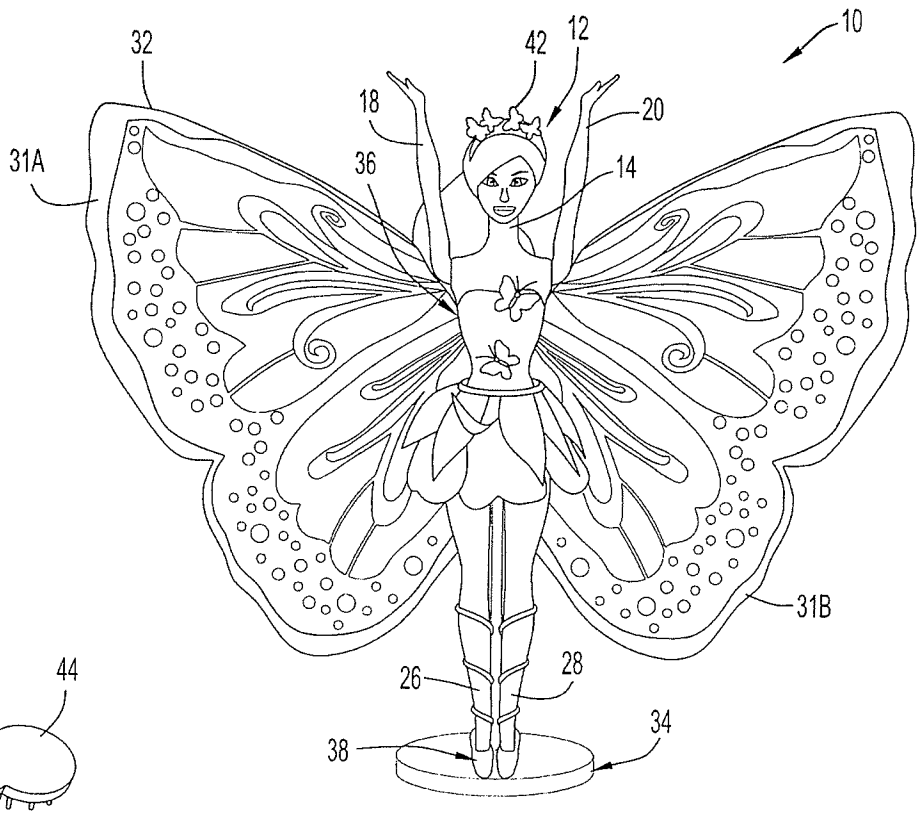
FIG. 6 illustrates a front view of the doll of FIG. 5 in a wings position or configuration when mounted on a stand.
Figure 5:
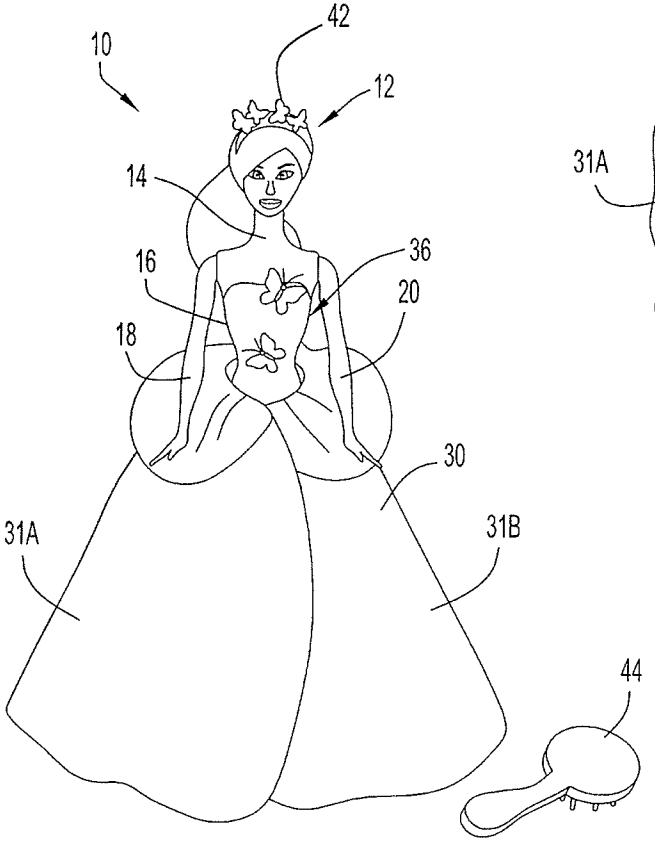
FIG. 5 illustrates a front view of another embodiment of a doll in a dress position or configuration when mounted on a stand.

FIGS. 1-2 illustrate a doll in a dress position or configuration and the doll in a wings position or configuration, respectively. FIGS. 3-4 illustrate another doll in a dress position or configuration and the doll in a wings position or configuration, respectively. Similarly, FIGS. 5-6 illustrate another doll in a dress position or configuration and the doll in a wings position or configuration, respectively.

Referring to FIGS. 1-2, doll 10 includes a head 12, a neck 14, a torso 16, a pair of arms 18 and 20 with respective shoulder joints 22 and 24, and a pair of legs 26 and 28 that form a lower portion of the doll 10 (see FIG. 2). Each of the arms and the legs can be referred to as an appendage for the doll 10. Doll 10 also includes a dress/wings that may be shaped like butterfly wings. In an alternative embodiment, the wings may have a configuration and shape different than butterfly wings. Each dress/wing may include a rigid support or skeleton over which one or more layers of flexible material may be mounted, for example, to retain a particular shape of dress/wings. The material may be a fabric material and the support may be a plastic member to which the fabric material is coupled.

Referring to FIG. 1, the doll 10 includes a dress or apparel portion 30 that covers at least part of the lower portion of the doll 10. The doll 10 with the dress 30 is referred to as being in a dress position or configuration. The dress 30 can be referred to as a dress-like structure. In this embodiment, the dress 30 covers the legs 26 and 28 of the doll 10. In an alternative embodiment, the dress 30 may cover less than the entire area of legs 26 and 28. The dress 30 is formed by two dress portions 31A and 31B that wrap around the legs 26 and 28 of the doll 10. While dress portion 31A is illustrated as overlapping dress portion 31B, in another implementation, dress portion 31B can overlap dress portion 31A. The dress portions 31A and 31B can be referred to as movable members or movable portions as well. In this configuration, the doll 10 has its arms 18 and 20 in lowered or down positions relative to the torso 16.

Referring to FIG. 2, the dress or apparel portion 30 of the doll 10 is converted or transformed to wings 32 for the doll 10. The wings 32 are foamed by dress portions 31A and 31B as shown. Each of the wings 32 extends outwardly from the torso 16 of the doll 10. The doll 10 with the wings 32 is referred to as being in a wing position or configuration. In this embodiment, the wings 32 extend laterally outwardly from the torso 16. Each wing 32 can be referred to as a wing-like structure.

As will be seen, doll 10 may further include a mechanism, such as an actuating assembly, that may allow the user to transform doll's dress 30 into wings 32 via user manipulation. The mechanism may also allow the user to selectively latch the wings in either the dress position, as shown in FIGS. 1, 3, 5, 15, and 16, or the wings position, as seen in FIGS. 2, 4, and 6, and 17. In addition, the user may selectively operate wings 32 in a fluttering motion.

Referring to FIG. 2, doll 10 may be positioned on a base or pedestal 34 and may additionally include a decorative bodice 36, a pair of shoes 38, and one or more accessories. It should be appreciated that bodice 36 and shoes 38 may or may not be removable from doll 10. For purposes of illustration, the accessories may include a hair clip 40, a hair band 42 (shown in FIGS. 3-4), and/or a hair brush 44. While only a certain number of accessories are illustrated in these examples, doll 10 may include any number of accessories or no accessories, and any such accessories may be positioned anywhere within and/or next to doll 10.

The various components of doll 10 and the accessories may be fabricated from any suitable material, such as plastic, foamed plastic, flexible plastic, one or more layers of fabric, wood, cardboard, pressed paper, metal, or any combination of materials. A suitable material or combination of materials may be selected to provide a desirable synergy of weight, strength. durability, cost, and/or manufacturability.

Head 12 may be mounted on neck 14 of torso 16. Head 12 may be configured to be movable in any direction relative to torso 16 and may further include human-like features with a beauty makeup and a fashion hair.

As described in the greater detail below, torso 16 may be partially or substantially hollow and may include a front section and a back section joined together by appropriate means, such as a connector or screw or a press fit connection of components of the sections. In one embodiment, the back and the front sections of torso 16 may be permanently joined together at one or more points. Optionally, the back and the front sections may not be permanently joined together for the purposes of repair and/or replacements of component parts of doll 10, if necessary. As described in greater detail below, the back section of torso 16 may further include a contoured slotted opening for positioning an actuating lever to facilitate an operative connection of the lever with the actuating assembly.

Arms 18 and 20 may be movably attached to torso 16 at shoulder joints 22 and 24, respectively. Shoulder joints 22 and 24 may be configured so as to allow a wide degree of pivoting. As will be seen, arms 18 and 20 may be rigidly connected together via an arm connector for simultaneous rotation relative to torso 16 along a common substantially horizontal axis. Optionally, arms 18 and 20 may be movably attached to torso 16 so as to enable each arm to pivot independently about respective shoulder joints 22 and 24. In addition, appropriate stoppers may be provided to effectively prevent arms from being pivoted beyond prescribed points and/or to allow for a desired clearance with wings 32 and/or other elements or members of doll 10.

Legs 26 and 28 may be movably attached to a lower portion of torso 16 at hip joints (not shown) to enable for a wide degree of pivoting about a substantially horizontal axis. Under some circumstances, however, it may be preferable to limit the relative rotational movement of legs 26 and 28 at the respective hip joints of doll 10. Legs 26 and 28 may be connected to torso 16 by a shared leg connector (not shown) configured to enable posing of legs 26 and 28 at a variety of pivotal positions. Further, legs 26 and 28 may be rigidly connected to each other or may be frictionally secured to torso 16 so as to enable independent rotational movements at the respective hip joints of doll 10.

Referring to FIGS. 3-4, the apparel of the doll 10 has a different appearance than the apparel of the doll 10 in FIGS. 1-2. Otherwise the doll 10 in FIGS. 3-4 has the same features and components as well as the functionality of the dress 30 and wings 32 as the doll 10 in FIGS. 1-2. Similarly, the doll 10 illustrated in FIGS. 5-6 has a similarly functioning dress 30 and wings 32.

Figure 6A:
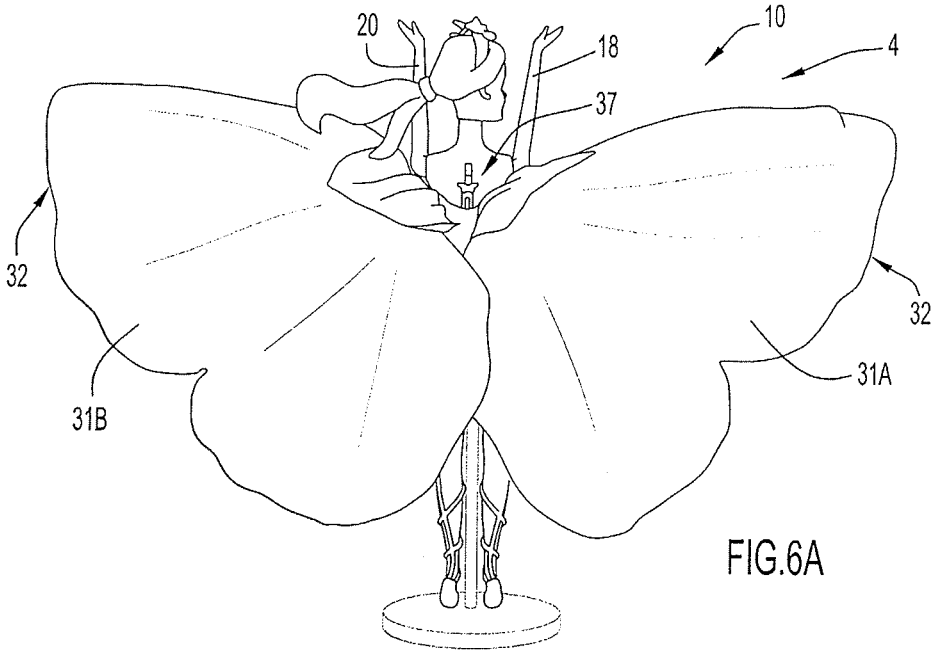
FIG. 6A illustrates a rear view of another embodiment of a doll in a wings position or configuration.
Figure 6B:
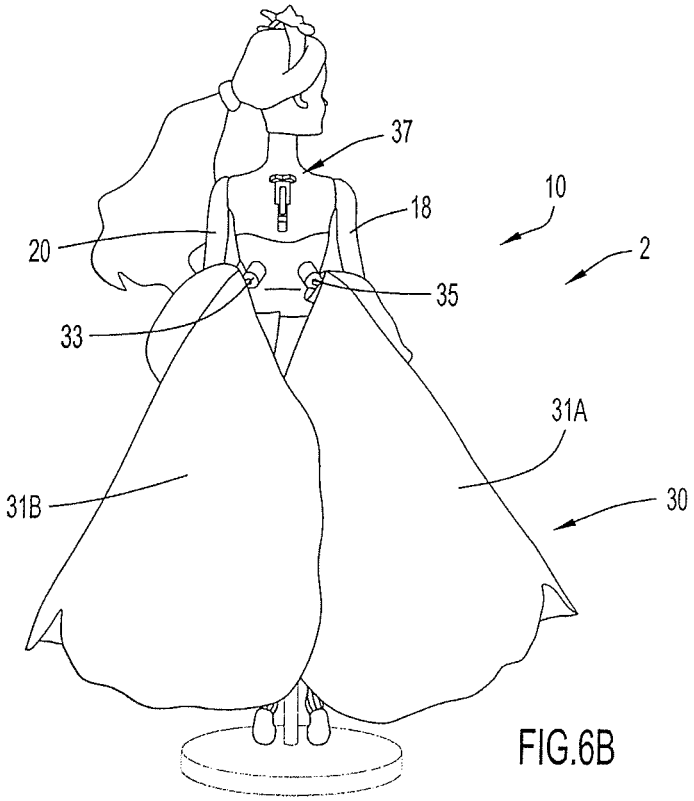
FIG. 6B illustrates a rear view of the doll of FIG. 6A in a dress position or configuration.

Referring to FIGS. 6A and 6B, rear views of the doll 10 in a wing configuration and in a dress configuration are illustrated, respectively. Referring to FIG. 6A, the doll 10 is in a wing or wings configuration 4 with the wings 32 deployed. Each dress or wing portion 31A and 31B is fully deployed and the arms 18 and 20 of the doll 10 are in their raised positions. The actuator 37 extending rearwardly from the back of the doll 10 is shown in its lower position in FIG. 6A.

Referring to FIG. 6B, the doll 10 is in a dress configuration 2 with the wings 32 converted into a dress 30 for the doll 10.

Flipping or support members (described in detail below) for dress or wing portions 31B and 31A are connected to couplers 33 and 35 for pivotal movement relative to the body of the doll 10. In this configuration, the arms 18 and 20 are lowered and the dress portions 31A and 31B wrap around the lower portion or legs of the doll 10. The actuator 37 has been moved to its upper position relative to the back of the doll 10 to move the movable members or portions 31B and 31A to their lower or dress positions.

Figure 7:
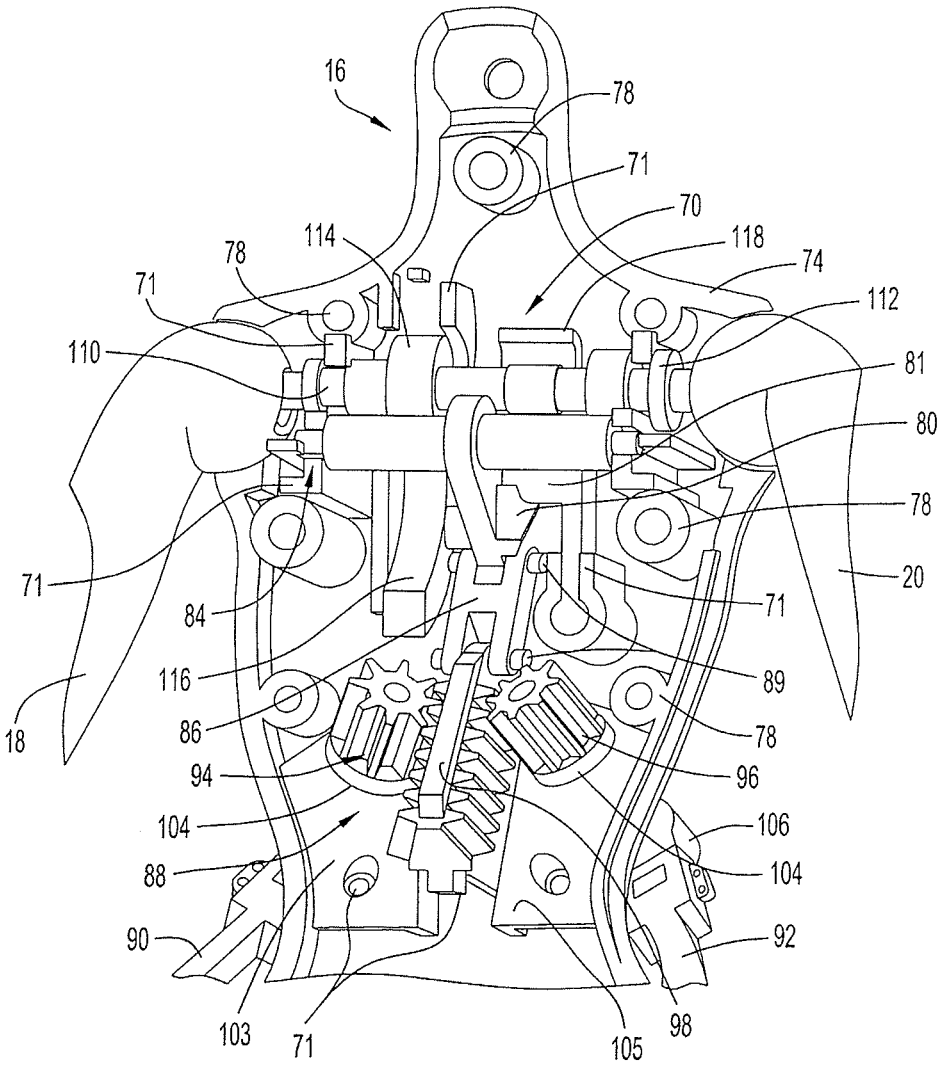
FIG. 7 illustrates a front perspective view of an embodiment of an actuating assembly housed within a torso, with the front portion of the torso removed.
Figure 8:
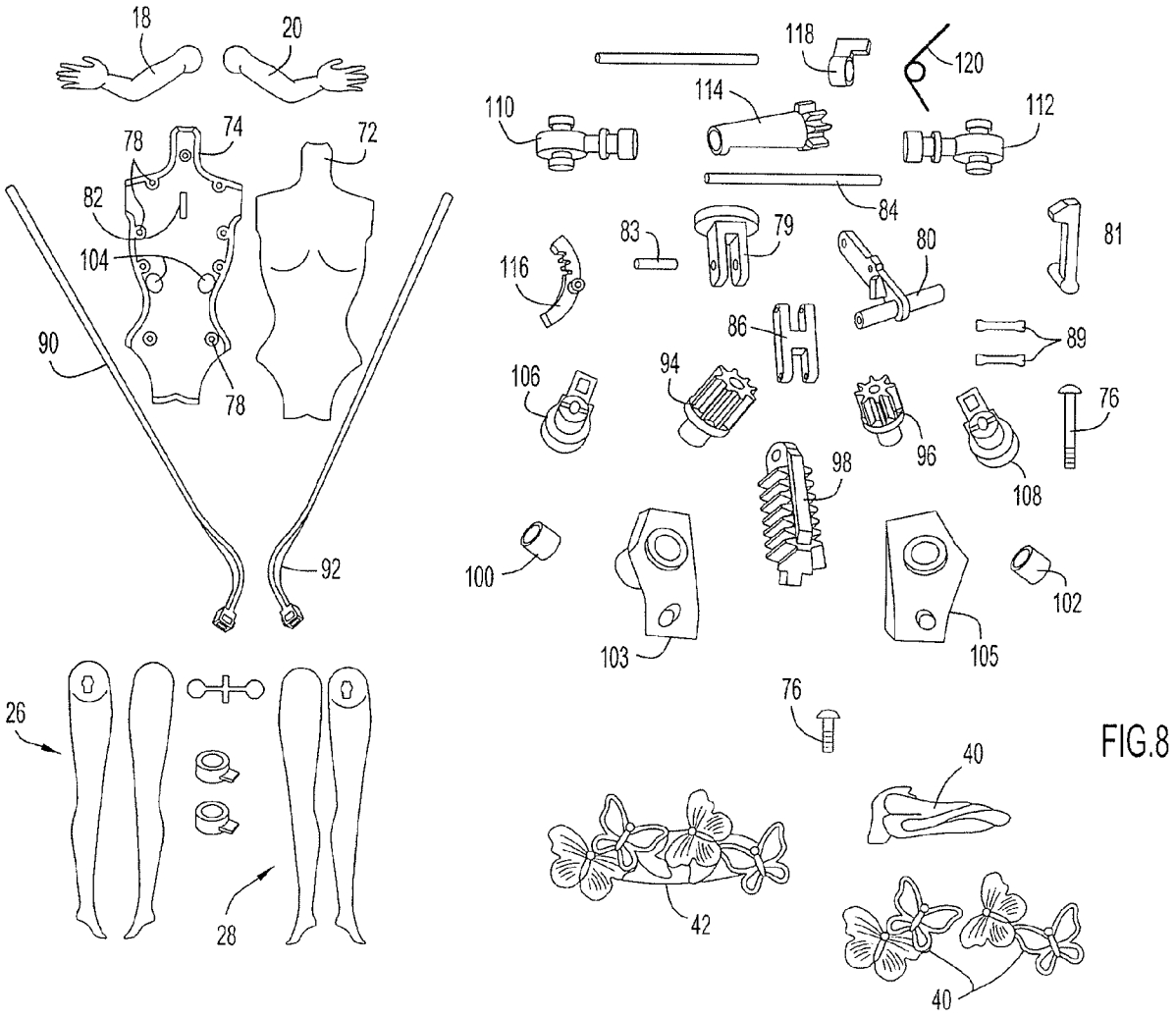
FIG. 8 illustrates some exemplary components of an embodiment of an actuating assembly, a doll, and the doll's accessories.
Figure 9:
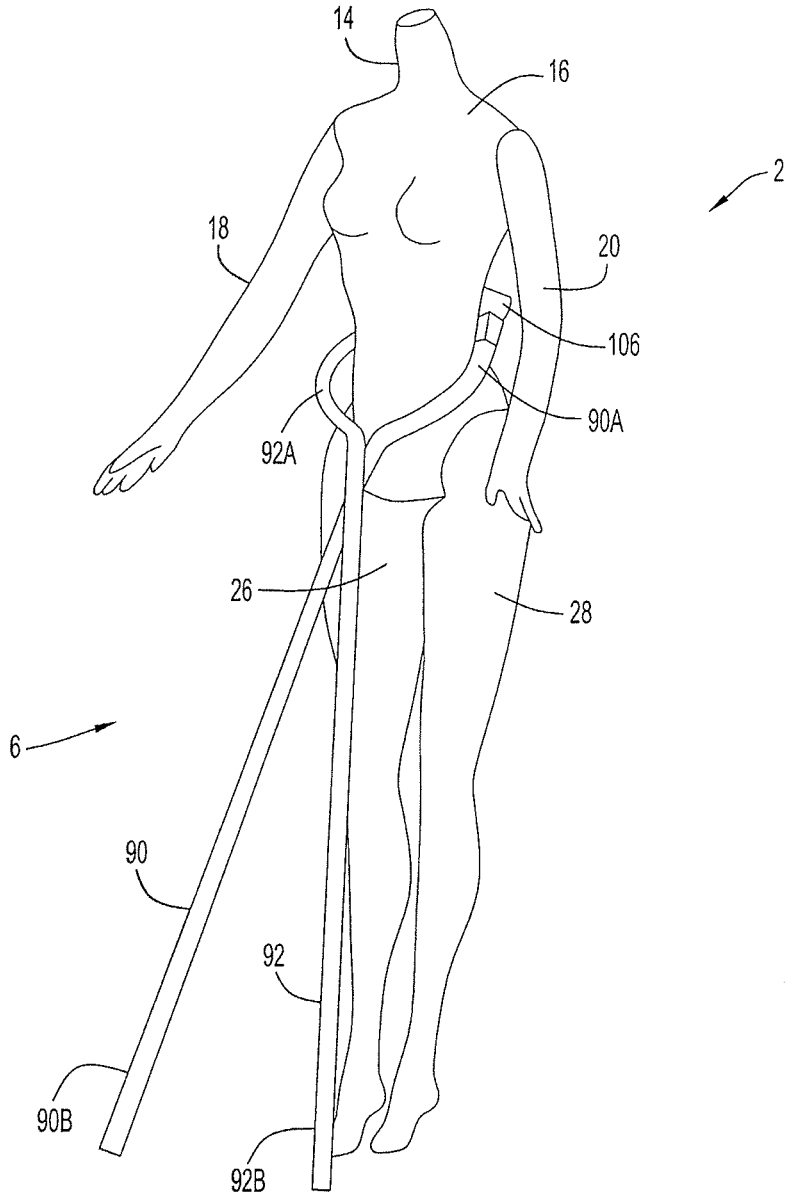
FIG. 9 illustrates a front perspective view of some components of an embodiment of a body of the doll shown in FIGS. 1-6 in a dress configuration.

As seen in FIGS. 7-9, an actuating assembly 70 of doll 10 may be housed within torso 16. Actuating assembly 70 may be secured within torso 16 by an inner support structure formed by several support members 71. A front portion or section 72 (not shown in FIG. 7) of torso 16 may be attached or coupled to a back portion or section 74 of torso 16 with screws 76, as explained further with reference to FIG. 8. Screws 76 may be configured to fit into mating portions 78 with openings formed on the inner part of back torso portion 74. Alternatively, posts on the front portion 72 may be inserted into mating portions 78.

The actuating assembly 70 may further include an elongated actuating lever, such as, for example, a T-shaped actuating lever 80 with a first or outer end portion projecting or protruding outwardly through a contoured slotted opening 82 in back portion 74 of torso 16, as has been previously mentioned and illustrated in FIG. 8. Actuating lever 80 may be operatively positioned on an arm clutch 81 and may further include a push button 79 secured to actuating lever 80 with a pin 83. The push button 79 is coupled to the outer end of the actuating lever 80 and can be grasped or engaged by a user to move the actuating lever 80. As seen in FIG. 7, the second or T-shaped end portion of actuating lever 80 may be movably secured within the inner support structure of back torso portion 74 by a lever pin 84 so as to allow the limited amount of pivoting of actuating lever 80 on or about lever pin 84.

In the configuration shown, an actuating link 86 may operatively connect actuating lever 80 to a gear train assembly 88 by one or more rods or pins, such as, for example, rivet pins 89. As will be seen, gear train assembly 88 may be configured for transmitting a relatively limited rotational motion of actuating lever 80 to a wide-degree rotational motion of flipping or support members 90 and 92 that form dress and wing portions.

Gear train assembly 88 may include one or more pinion gears 94 and 96 that may be matingly engaged with and driven by one or more toothed regions of a wedge-shaped gear rack 98. Gear rack 98 may be configured to have any desired shape and/or cross-section to further its particular function. Gear rack 98 may have teeth along all or a portion of its surface and may be spring-loaded. In this embodiment, the gear rack 98 has two angled side portions, each of which has teeth spaced therealong. Further, gear rack 98 may be slidably retained within one or more inner structure support members 71 to allow for a linear reciprocal motion. It should be noted that pinion gears 94 and 96 may have their respective axes offset angularly or, optionally, may have their axes aligned.

Each pinion gear 94 and 96 may be operatively connected to angled cylindrical stub shafts or posts 100 and 102, respectively (shown in FIG. 8), which may project outwardly through apertures 104 and gear holders 103 and 105 in the back portion of torso 16. The outer end of first post 100 may be forceably secured to a first coupling device 106 that may be affixed to first flipping or support member 90. Similarly, the outer end of second post 102 may be forceably secured to a second coupling device 108 affixed to second flipping or support member 92. In one embodiment, the coupling devices 106 and 108 may be configured differently so that a user connects the correct flipping or support member 90 or 92 to the particular coupling device 106 or 108. In other words, by configuring the coupling devices 106 and 108 differently, proper assembly of the support members 90 and 92 to the doll 10 is achieved.

Arm connectors 110 and 112 may be rigidly attached at one of their ends to arms 18 and 20, respectively, for simultaneous rotation about a substantially horizontal axis. An arm gear 114 may be positioned between and rigidly secured to arm connectors 110 and 112 to facilitate a rotational movement of arms 18 and 20 by use of a crescent-shaped arm rack 116. Arm rack 116 may be operatively linked to actuating lever 80 and may have a toothed region along all or a portion of its inner perimeter. The toothed region of arm rack 116 may be configured to be matingly engaged with the toothed region of arm gear 114 so that a rotational movement of actuating lever 80 about lever pin 84 imparts a rotational movement to arm rack 116 and arm connectors 110 and 112, thus, facilitating a simultaneous rotation of arms 18 and 20 from a lowered position to a raised position, as illustrated in FIGS. 1-6.

An arm stopper 118 may be positioned on arm gear 114 to cooperate with arm gear 114 and arm connectors 110 and 112 to limit and to effectively prevent arms 18 and 20 from being pivoted beyond prescribed points. One or more resilient members, such as a spring 120 (shown in FIG. 8), may be positioned within the actuating assembly to facilitate a fluttering motion of the wings.

In assembled relationship, actuating lever 80 and, more specifically, actuating link 86 may engage gear rack 98 to travel downward and to simultaneously rotate respective pinion gears 94 and 96 in clockwise and counterclockwise directions. The rotation of pinion gears 94 and 96 facilitated by the interconnection with coupling devices 106 and 108 may cause flipping or support members 90 and 92 to engage in wide rotational movements, thus, transforming doll's dress 30 into wings 32.

Figure 9A:
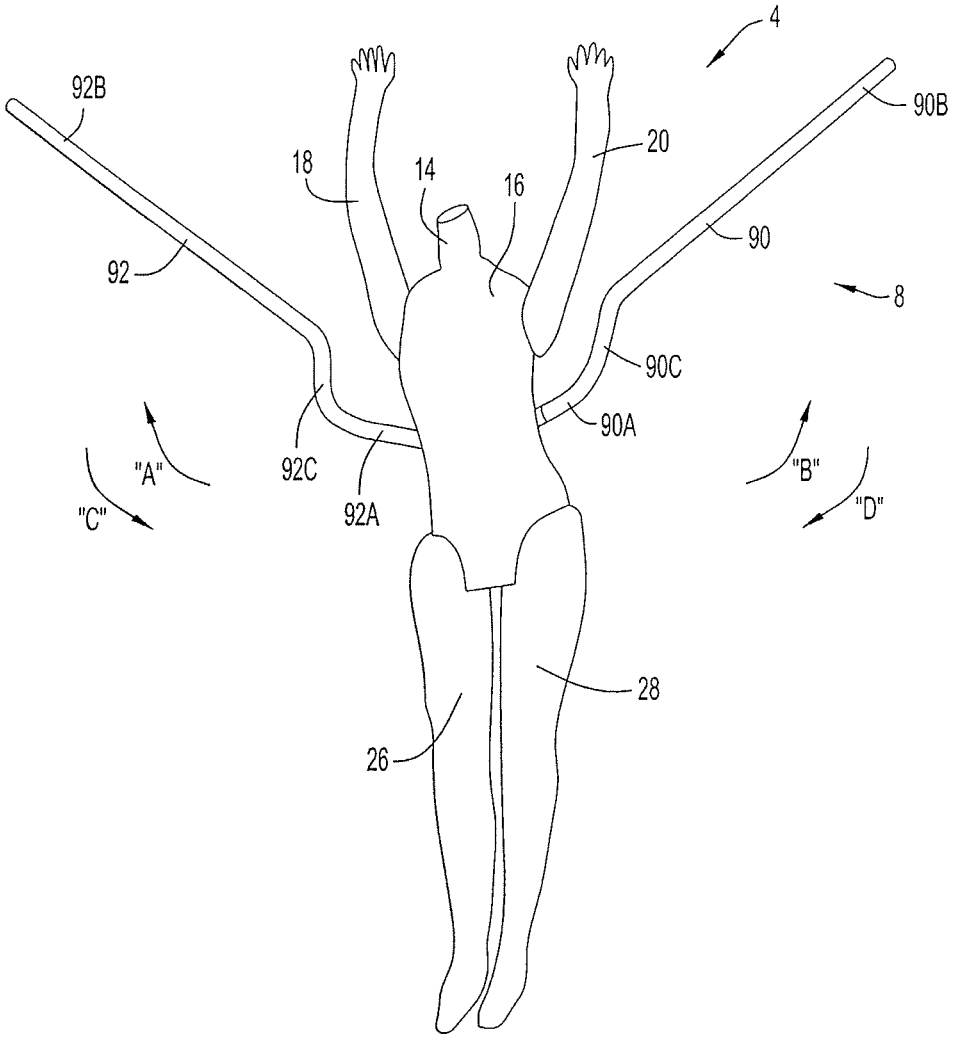
FIG. 9A illustrates a front perspective view of the doll shown in FIG. 9 in a wings configuration.

Referring to FIGS. 9 and 9A, the movement and relative positions of the flipping or support members 90 and 92 are illustrated. Members 90 and 92 are illustrated in FIGS. 9 and 9A without the rest of the dress or wing portions for ease of reference. Flipping or support members 90 and 92 (fully shown in FIG. 9) may be releasably retained in the dress position or in the wings position. In the present example, the user may lock flipping or support members 90 and 92 into the wings position by pulling actuating lever 80 downward so as to engage an internal lock mechanism. Pushing actuating lever 80 in the opposite direction may lower flipping or support members 90 and 92 to the dress position.

Member 90 has a proximal end 90A, a distal end 90B, and a curved portion 90C between the ends 90A and 90B. Similarly, member 92 has a proximal end 92A, a distal end 92B, and a curved portion 92C between the ends 92A and 92B. Referring to FIG. 9, the members 90 and 92 are illustrated in their lower positions 6, which can be referred to as dress positions. When the members 90 and 92 are in their lower positions 6, the doll 10 is in a dress position or configuration 2. As shown, the curved portions 90C and 92C are configured to wrap around a portion of the body of the doll 10, thereby allowing the members 90 and 92 to overlap each other in front of the doll 10. The overlapping or crossing over of the members 90 and 92 results in the dress or wing portions overlapping as referenced above and as shown in FIGS. 1, 3, and 5. In addition, the arms 18 and 20 of the doll 10 are illustrated in lowered or down positions relative to the body of the doll 10.

Referring to FIG. 9A, a user has actuated the actuating assembly to move the flipping or support members 90 and 92 and the arms 18 and 20 upwardly. When actuated, the actuating assembly moves the members 90 and 92 upwardly and outwardly along the directions of arrows "A" and "B" to upper or wing positions 8. When the members 90 and 92 are in their upper or wing positions 8, the doll 10 is in a wing position or configuration 4. Simultaneously with the movement of the members 90 and 92, the arms 18 and 20 of the doll 10 move to upper or raised positions as well.

The curved portions 90C and 92C and overall configuration of the support members 90 and 92 result in the distal ends 90B and 92B of the members 90 and 92 extending upwardly and outwardly relative to the body of the doll 10. When the dress or wing portions are coupled to the support members 90 and 92, the wing portions are positioned in their fully spread out wing or wing-like configurations when the support members 90 and 92 are in their positions 8 as shown in FIG. 9A. The members 90 and 92 can be moved downwardly along the directions of arrows "C" and "D" to their lowered or dress positions 6 (see FIG. 9).

In the present example, the doll 10 and actuating assembly 70 may have a plurality of components, as illustrated in FIG. 8 as described above. The various components are described herein and involved in the movement of the arms and the flipping or support members as illustrated.

Figure 11:
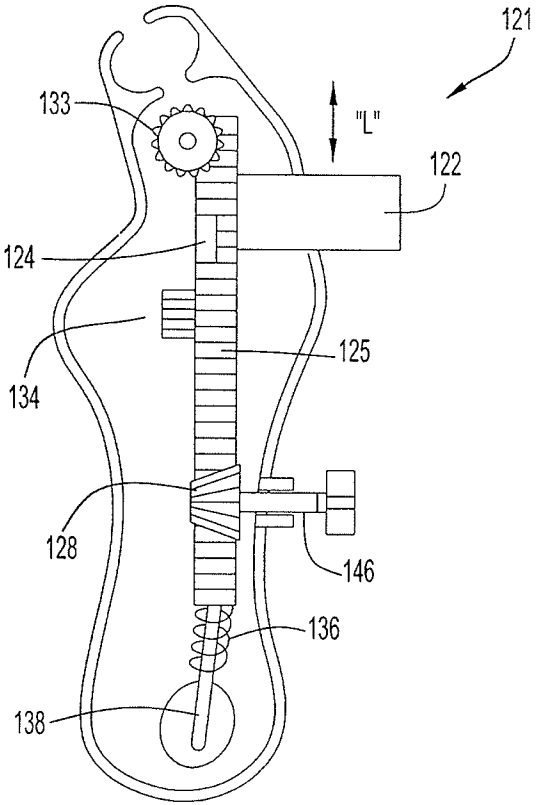
FIG. 11 illustrates a partial cross-sectional side view of an embodiment of a doll with the actuating assembly shown in FIG. 10.
Figure 12:
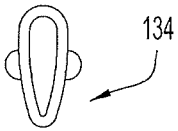
FIG. 12 illustrates a view of a detent lock for the actuating assembly shown in FIGS. 10-11.
Figure 10:
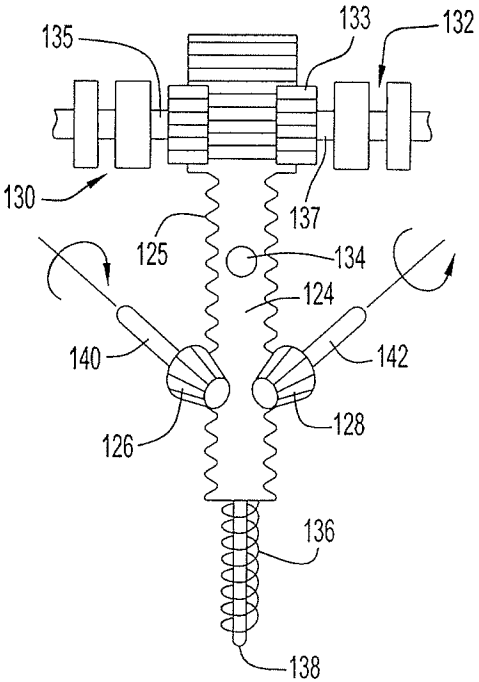
FIG. 10 illustrates a front view of an embodiment of an actuating assembly.
Figure 13:
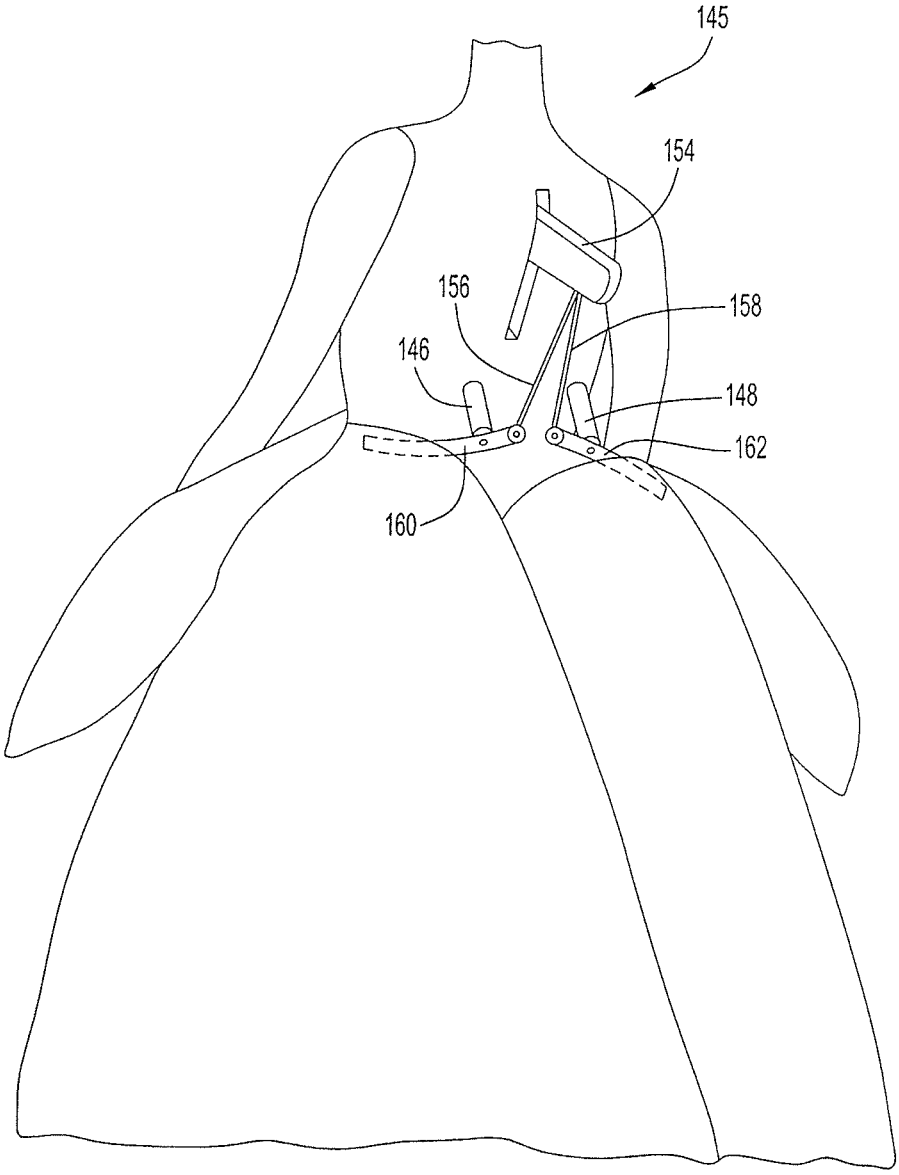
FIG. 13 illustrates a rear perspective view of an embodiment of an actuating assembly for a doll.
Figure 14:
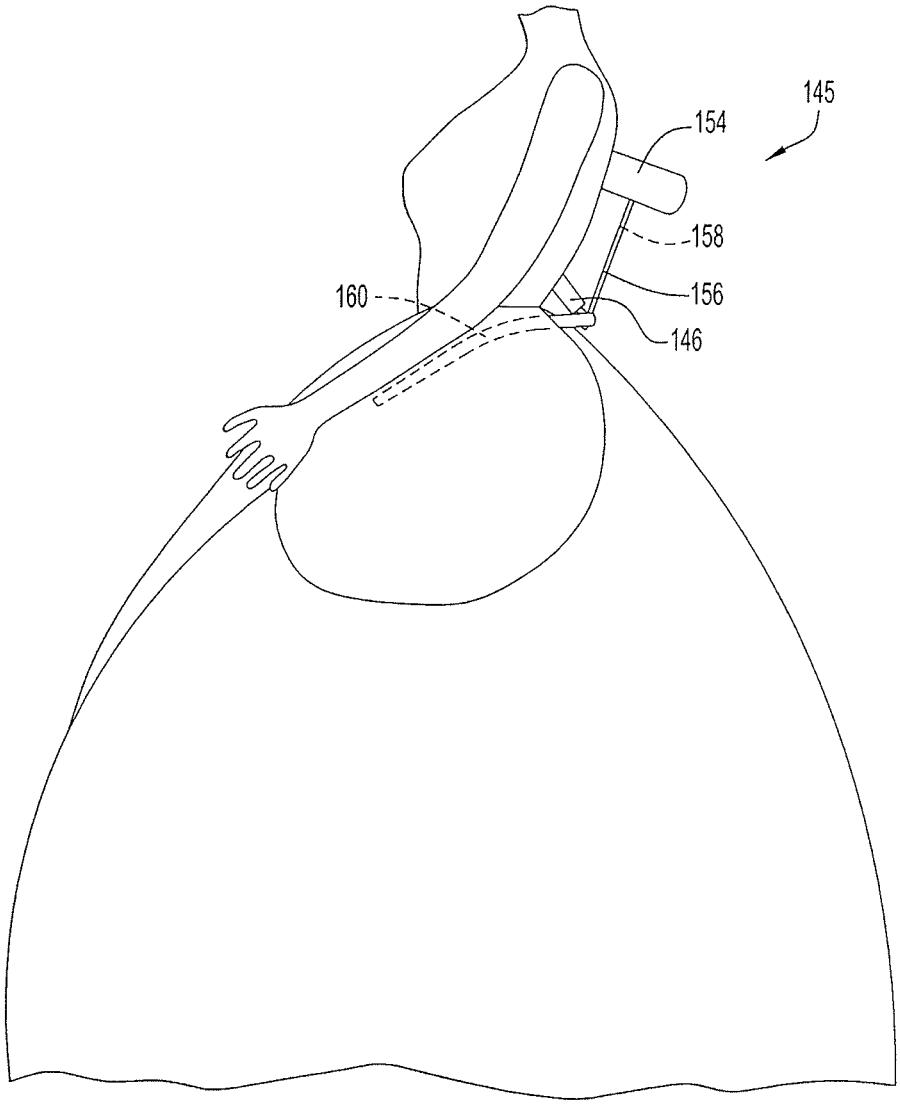
FIG. 14 illustrates a side view of the actuating assembly and doll shown in FIG. 13.
Figure 15:
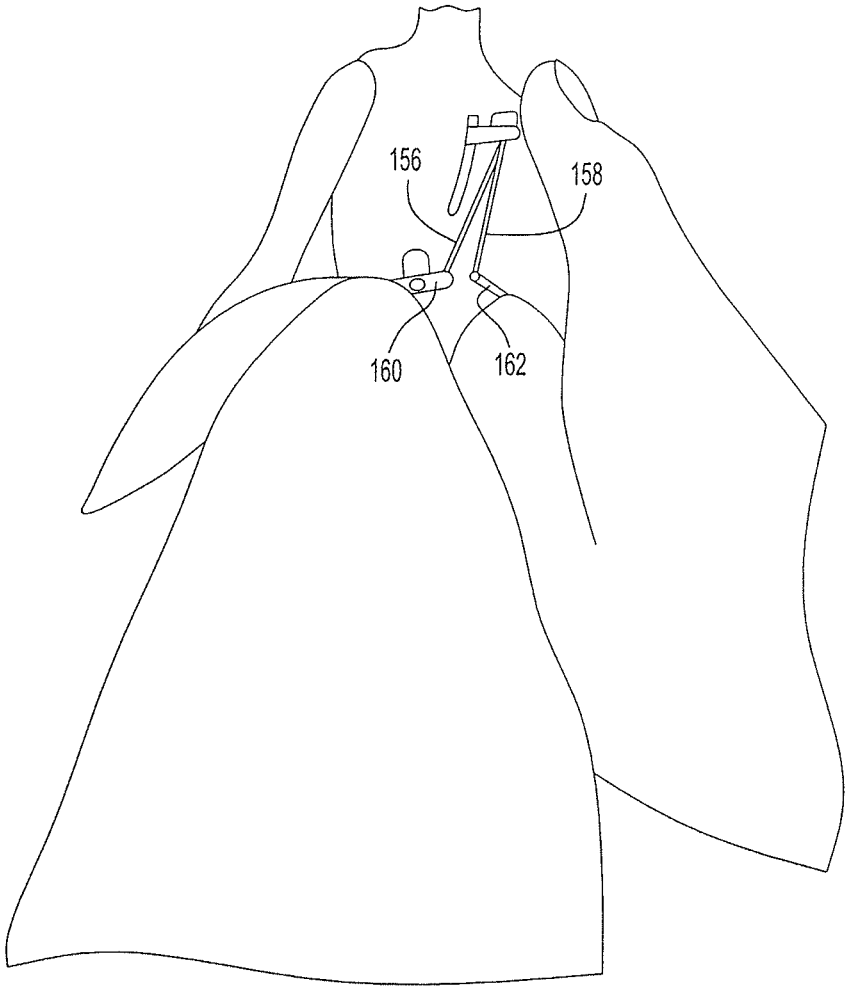
FIG. 15 illustrates a rear perspective view of an alternative embodiment of a doll with an actuating assembly, when doll is in the dress position or configuration.
Figure 16:
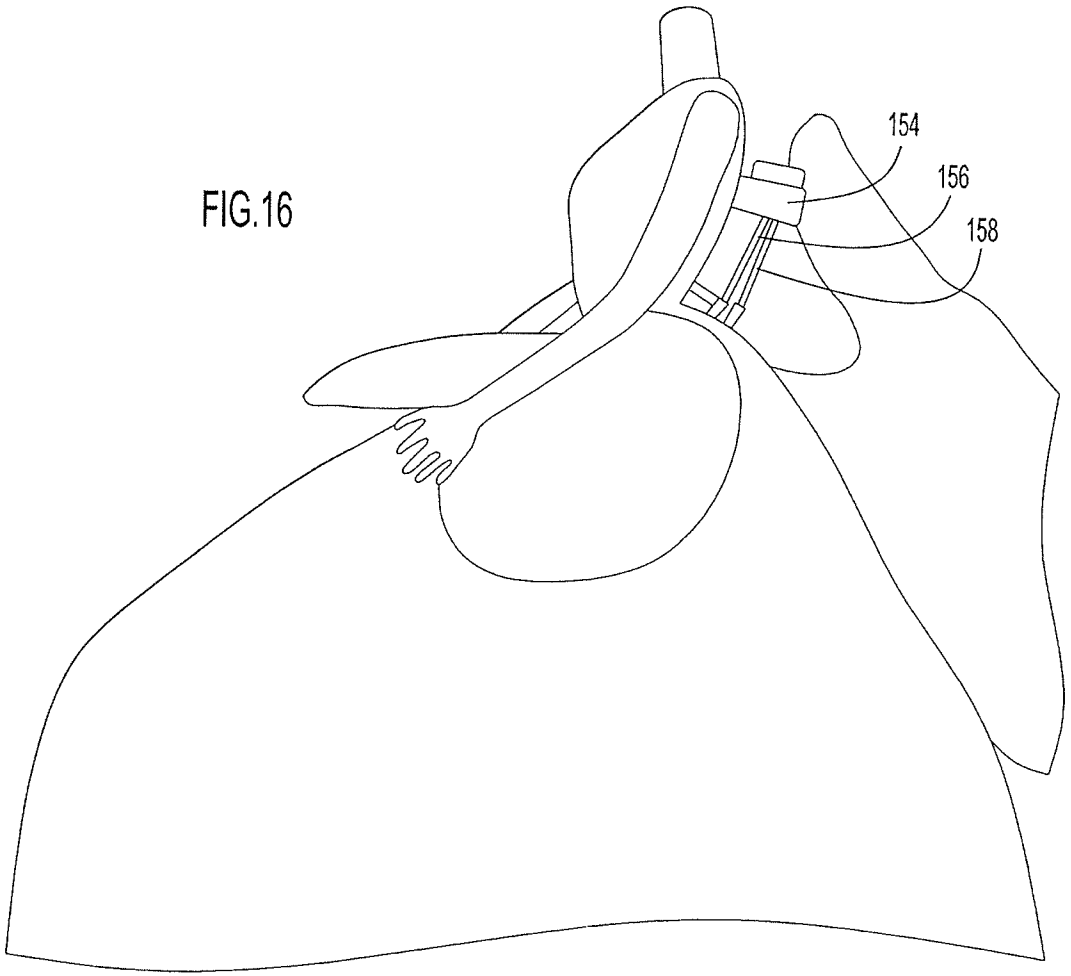
FIG. 16 illustrates a side view of the doll shown in FIG. 15.
Figure 17:
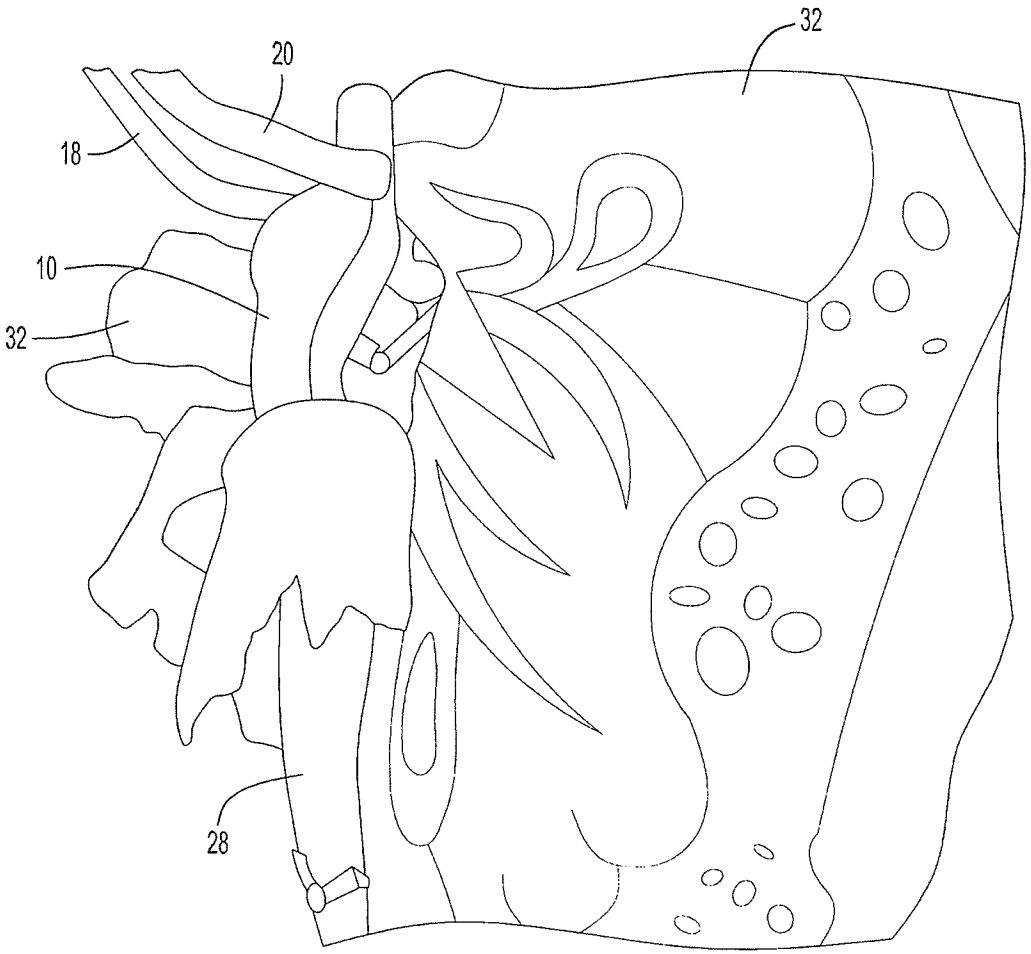
FIG. 17 illustrates a side view of the doll shown in FIG. 15, when the doll is in the wings position or configuration.

FIGS. 10-12 illustrate an exemplary embodiment of an actuating assembly 121 configured for translating a linear motion of an actuating lever 122 (as indicated by arrow L) into a rotational motion of flipping or support members (not shown in FIGS. 10-12). Actuating lever 122 may be rigidly secured to a gear rack 124 by appropriate means, such as a connector. Gear rack 124 may include teeth 125 along all or a portion of its perimeter and may be configured to engage with the teeth of bevel gears 126 and 128. In one embodiment, the gear rack 124 has opposite sides, each of which has teeth 125 therealong. Gear rack 124 may be further operatively connected to arm connectors 130 and 132 by use of an arm connector gear 133. Arm connectors 130 and 132 may be rigidly attached at their outer ends to arms (not shown) for simultaneous rotation about a substantially horizontal axis. Arm connector clutches 135 and 137 may be movably attached to respective arm connectors 130 and 132 so as to enable each arm to pivot independently about the respective shoulder joints. Arm connector clutches 135 and 137 may also be configured to prevent arms from rotating beyond prescribed points.

The user may push actuating lever 122 downward causing arm connector gear 133 and bevel gears 126 and 128 to be engaged with and simultaneously driven by gear rack 124. Bevel gears 126 and 128 may have their respective shafts 140 and 142 operatively secured to the respective flipping or support members via rotating points (not shown) to impart a wide rotational movement, thus, transforming doll's dress 30 into wings 32.

Actuating assembly 121 may further include a lock mechanism that may releasably retain the flipping or support members in the wings position. As a way of illustration, gear rack 124 may be locked in place by the appropriate means when actuating lever 122 is pushed down past a detent lock 134. Pushing actuating lever 122 up past detent lock 134 may lower arms and may return flipping or support members to the dress position.

In the present example, a resilient member or compression spring 136 may bear on a foot portion of gear rack 124 and may surround a fitted rod 138. Compression spring 136 may be interposed between the foot portion of gear rack 124 and the lower portion of doll's torso 16. The compression and release of compression spring 136 may be mechanically powered by the movement of actuating lever 122 and may bring about the wing fluttering motion. A wing clutch assembly 146 may further prevent the user from accidentally damaging the components of actuating assembly 121.

FIGS. 13-17 depict an exemplary embodiment of a doll with an actuating assembly 145 having two angled posts 146 and 148 that may extend out of the back of doll 10. A pair of flipping or support members 160 and 162 may be pivotally mounted on corresponding posts 146 and 148. An actuating lever 154 may be connected to each flipping or support member with rigid connector wires 156 and 158, respectively, so that pushing down on actuating lever 154 may pivot flipping or support members 160 and 162 from the dress position to the wings position.

Actuating assembly 145 may further include necessary springs, latches, levers, wires, stoppers, and connection points between actuating lever 154 and flipping or support members 160 and 162 so as to reverse the direction of one part relative to the other, or to allow the user to easily flap the wings positioned on flipping or support members 160 and 162, or to latch flipping or support members 160 and 162 in either the dress position or the wings position.

Referring to FIGS. 18-31, another embodiment of a doll is illustrated. In this embodiment, the doll 200 has a body 210 with a back portion or section 212 with a neck section or portion 214. The back portion 212 has two shoulder openings 216 and 218 formed therein. Integrally formed with the back portion 212 are guides 230 and 240 (see FIGS. 18, 19, and 21).

Figure 18:
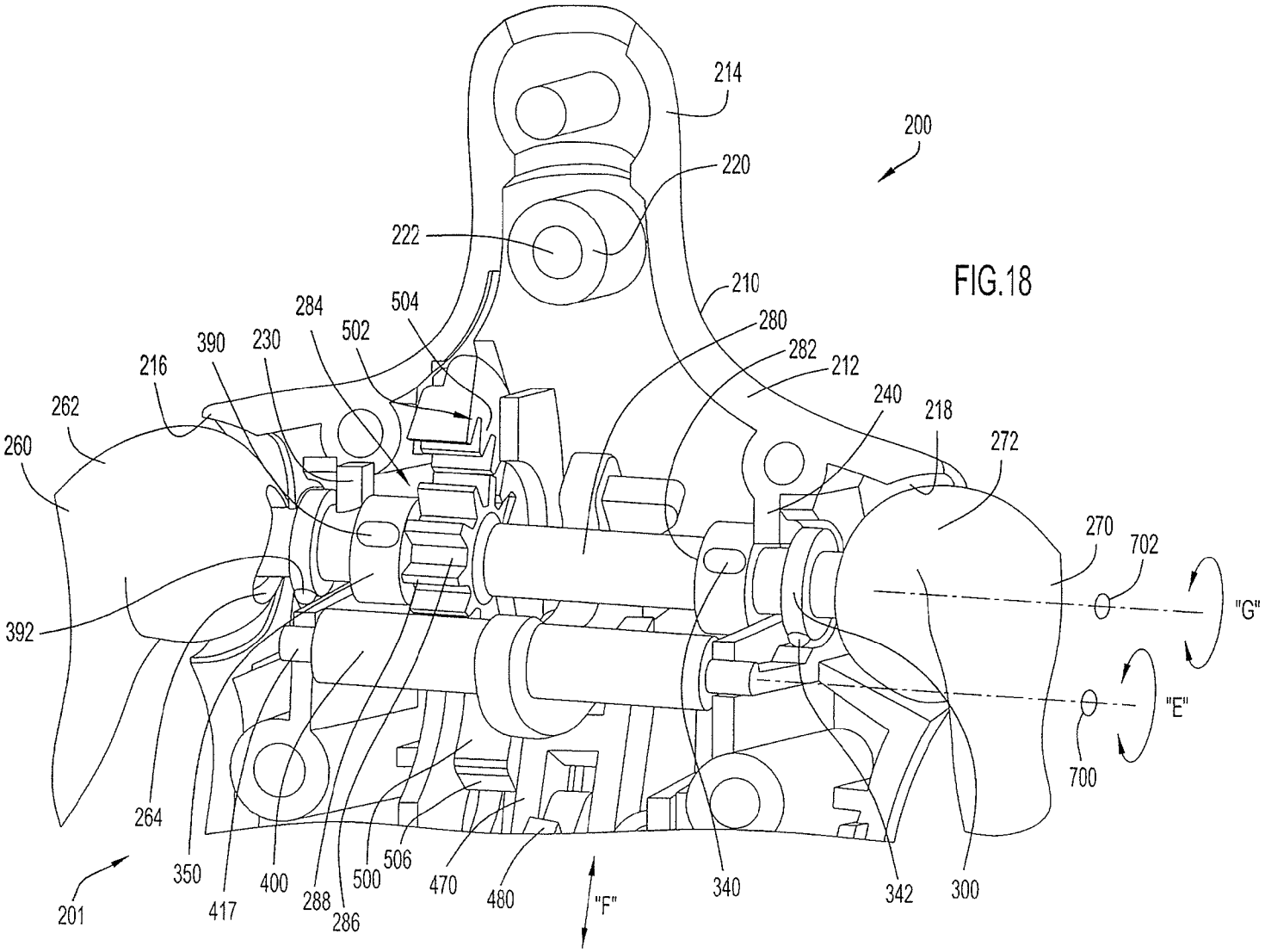
FIG. 18 illustrates a partial internal view of some of the components of an embodiment of a doll.

Referring to FIG. 18, the doll 200 includes an arm 260 with an upper end 262 that has an opening 264 formed therein. Similarly, the doll 200 includes an arm 270 on an opposite side with an upper end 272 with an opening (not shown). The drive or actuating assembly 201 of the doll 200 includes connectors 300 and 350 that are coupled to the arms 270 and 260, respectively.

Figure 19:
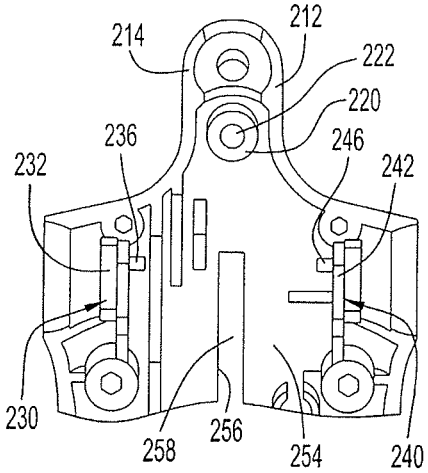
FIG. 19 illustrates a front view of part of the rear portion of the doll shown in FIG. 18.
Figure 20:
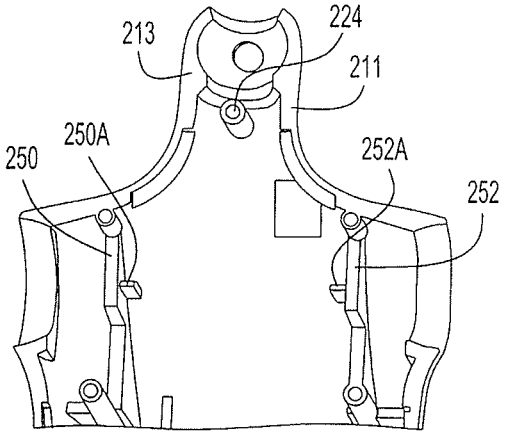
FIG. 20 illustrates a rear view of part of the front portion of the doll shown in FIG. 18.
Figure 21:
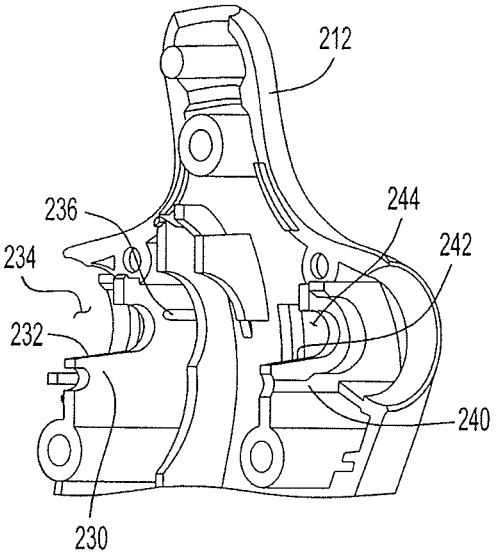
FIG. 21 illustrates a perspective view of the rear portion of the doll shown in FIG. 19.

Referring to FIGS. 19-22, some components of the doll 200 are illustrated. In FIGS. 19 and 21, back portion 212 has several mounting elements 220, each of which includes an opening 222. Guides 230 and 240 have surfaces 232 and 242 that include recesses 234 and 244, respectively. Connector 300 is disposed in recess 244 and connector 350 is disposed in recess 234. The back portion 212 includes limits or stops 236 and 246 that control or limit the movement of the arms of the doll 200. The back portion 212 includes a rear wall 254 that has an edge 256 that defines a slot or opening 258 therethrough.

Figure 22:
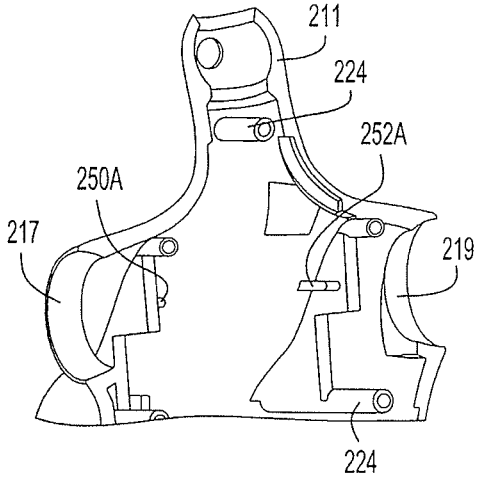
FIG. 22 illustrates a perspective view of the front portion of the doll shown in FIG. 20.

Referring to FIGS. 20 and 22, the front portion 211 has a neck portion 213 and several mounting elements 224, each of which is inserted into a corresponding opening 222 in an element 220 on the back portion 212. The front portion 211 includes several guides 250 and 252 that include limits or stops 250A and 252A, respectively. As shown in FIG. 22, the front portion 211 also includes shoulder openings 217 and 219.

Figure 23:
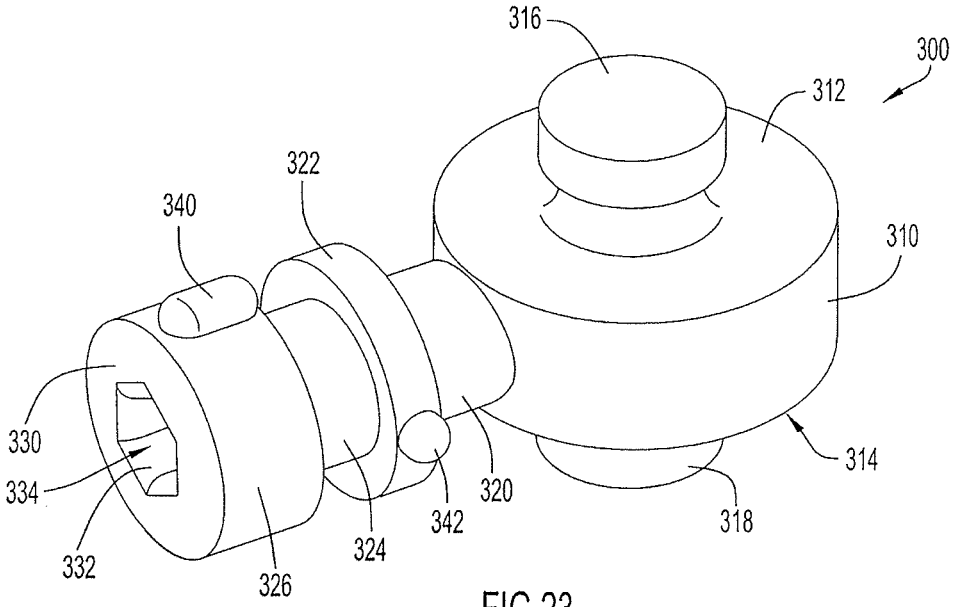
FIG. 23 illustrates a perspective view of a connector of the doll shown in FIG. 18.
Figure 24:
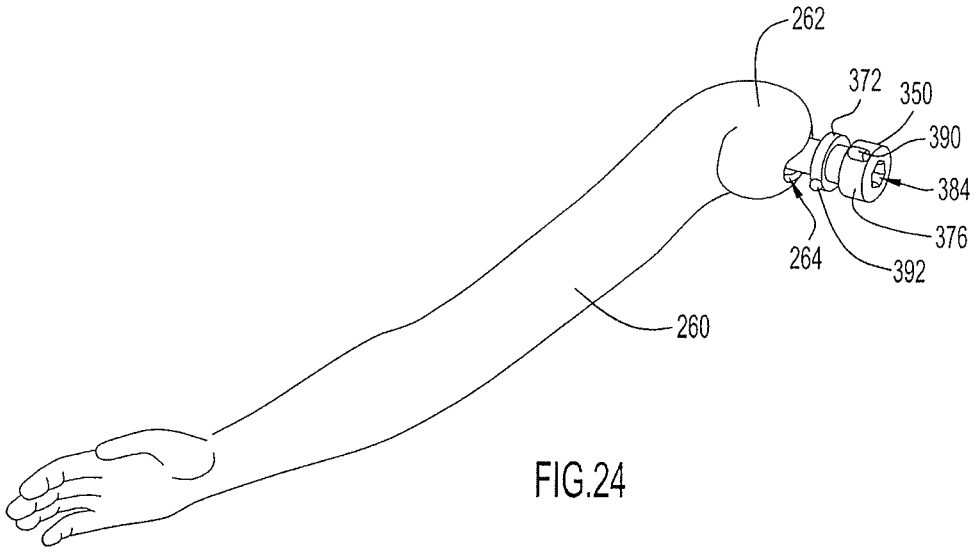
FIG. 24 illustrates a perspective view of an arm of the doll shown in FIG. 18 and another connector coupled to the arm.
Figure 23A:
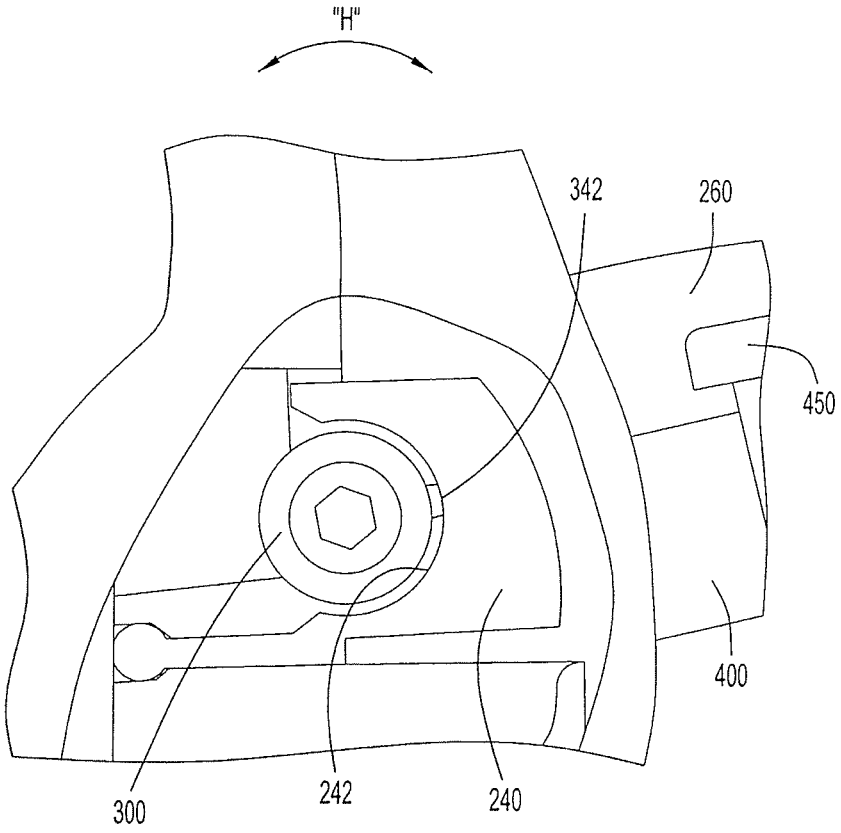
FIG. 23A illustrates an internal view of some components of the doll shown in FIG. 18.

Referring to FIGS. 23, 23A, and 24, different embodiments of connectors are illustrated. Connectors 300 and 350 are molded plastic components and are used to couple the arms 260 and 270 to the drive or actuating assembly of the doll 200. In FIG. 23, connector 300 has a body portion 310 with opposite sides 312 and 314 with extensions or couplers 316 and 318 extending therefrom, respectively. Body portion 310 is inserted into an opening formed in the upper end 272 of the arm 270. Coupled to the body portion 310 is a shaft with several portions having different diameters. The shaft includes portions 320 and 324 with smaller diameters and portions 322 and 326 with larger diameters. As shown in FIG.

18, portion 324 is aligned with and receives guide 240, thereby permitting rotation of the connector 300 and the arm 270.

Connector 300 also includes an end 330 in which an opening 334 defines by walls 332 is formed. In this embodiment, the opening 334 has a configuration that mates with and receives an end of the shaft 280 so that rotation of the shaft 280 results in rotation of the connector 300 and the arm 270. Connector 300 includes nubs or protrusions 340 and 342 coupled to shaft portions 322 and 326 as shown. The nubs 340 and 342 engage different surfaces on the interior of the doll 200 during different rotational movements of the connector 300. The nubs 340 and 342 can be formed integrally with the rest of the connector 300 or formed separately from the connector 300 and subsequently coupled thereto. In this embodiment, the nubs 340 and 342 have different sizes and configurations. In other embodiments, the sizes and configurations of the nubs 340 and 342 may be the same. The nubs 340 and 342 may be made of a relatively high friction material, such as a rubber material.

In one embodiment, arm 260 has a desired range of motion and desired positions relative to the body 210. The nubs 340 and 342 are positioned so that the user feels resistance to movement of the arm 260 beyond the desired range. In other words, when one of the nubs 340 and 342 engages a surface inside of the doll 200, further rotation or movement of the arm 270 is difficult and the user knows that the normal range of the arm 270 has been reached. In addition, when the transformation of the doll 200 between a wing configuration and a dress configuration is desired, the arms of the doll 200 should be in particular positions relative to the body 210 of the doll 200. For example, the arms 260 and 270 should be placed in down or lowered positions relative to the body 210 to facilitate the reconfiguration of the doll 200 from its dress configuration to its wings configuration. Similarly, the arms 260 and 270 should be placed in upper or raised positions relative to the body 210 to facilitate the reconfiguration of the doll 200 from its wings configuration to its dress configuration.

To assist with arm 270 being in its proper position prior to the reconfiguration of the doll 200, the nubs 340 and 342 function as guides. The arm 270 moves more freely in the recommended or desired positions and range of motion. The user will feel increased resistance and friction if arm 260 is not in its proper position prior to transformation or if the arm 270 is moved beyond its desired position. Thus, during play, the arms 260 and 270 may be moved and the nubs on the connectors 300 and 350 facilitate reconfiguration of the doll 200 by generating a stiff or resistant feeling when a user moves the arms 260 and 270 in an undesired manner or tries to reconfigure the doll 200 with the arms 260 and 270 in incorrect positions.

Referring to FIG. 23A, the arms (only arm 260 is illustrated) have been rotated so that they extend rearwardly from the body of the doll 200. The nub 342 on connector 300 rubs and slides along surface 242 of guide 240 when the arms are rotated along the direction of arrow "M" along this position. The friction of the hub 342 with the surface 242 provides additional resistance to the user during rotation of the arms in this positions and proximate positions thereby alerting the user that the arm is not in the desired range of positions.

As shown in FIG. 24, the doll 200 includes another connector 350 that has a similar configuration to connector 300. Connector 350 has the same configuration, but the locations of the nubs 390 and 392 on portions 376 and 372 are switched as compared to connector 300. As shown in FIG. 24, connector 350 is inserted into opening 264 formed in the end 262 of arm 260. As shown in FIG. 18, the connector 350 is aligned with and receives guide 230, thereby permitting rotation of the connector 350 and the aim 260.

Connector 350 also includes an end in which an opening 384 is formed. Opening 384 receives an end of the shaft 280 so that rotation of the shaft 280 results in rotation of the arm 260. The nubs 390 and 392 engage different surfaces on the interior of the doll 200 during different rotational movements of the connector 350. The nubs 390 and 392 function in the same manner as nubs 340 and 342 on connector 300. Nubs 390 and 392 are positioned so that they engage an inner surface of the doll 200 at the same time that nubs 340 and 342 do, thereby performing the same function at the same time.

Figure 25:
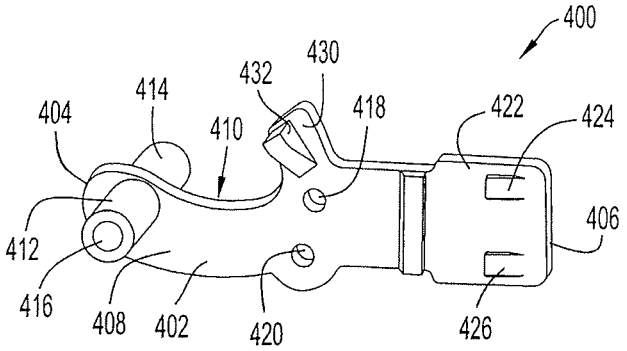
FIG. 25 illustrates a perspective view of an actuator of the doll shown in FIG. 18.

Referring to FIG. 25, an embodiment of a lever or actuator is illustrated. In this embodiment, the lever 400 includes a body 402 with an inner end 404 and an outer end 406 that is located external to the body 210 of the doll 200. The body 402 has opposite sides 408 and 410 and extensions 412 and 414 that are integrally formed with the body 402 and extend outwardly therefrom. The extensions 412 ands 414 are aligned and include a channel 416 through which a pin or shaft 417 is inserted and extends to mount the lever 400 to the body 210. The shaft 417 defines an axis about which the lever 400 rotates or pivots.

The body 402 includes an extension 430 with a projection 432 extending from one side. The projection 432 functions as a stop or limit with respect to the movement of the arms 260 and 270. Holes or openings 418 and 420 are formed through the body 402 and are configured to receive a connector to couple the lever 400 to other components of the drive or actuating assembly such as a link or geared member. In this embodiment, the lever 400 includes a mounting portion 422 that has projections 424 and 426 integrally formed therewith. The mounting portion 422 is located outside of the body as shown in FIG. 27.

Figure 26:
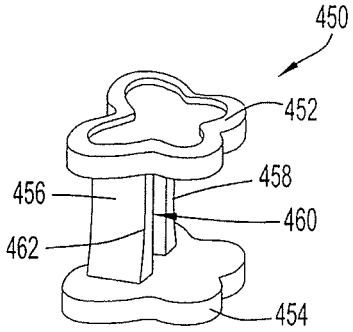
FIG. 26 illustrates a perspective view of a clip of the doll shown in FIG. 18.

Referring to FIG. 26, an embodiment of clip that can be used with lever 400 is illustrated. In this embodiment, the clip 450 includes plates 452 and 454 that are coupled together by spaced apart supports 456 and 458. The supports 456 and 458 define an opening or gap 460 therebetween. The gap 460 is configured to receive the mounting portion 422 of the lever 400. As shown in FIG. 27, after the clip 450 has been slid onto the mounting portion 422 of the lever 400 a sufficient distance, the projections 424 and 426 on the lever 400 engage surface 462 of support 456, thereby preventing the easy disengagement of the clip 450 from the lever 400. In one embodiment, the mounting portion 422 of the lever 400 includes one or more similar projections that extend outwardly and engage a surface of the clip 450 to retain the clip 450 on the lever 400. In one embodiment, the lever 400 is an integrally molded plastic article. Similarly, the clip 450 is also an integrally molded plastic article.

Figure 27:
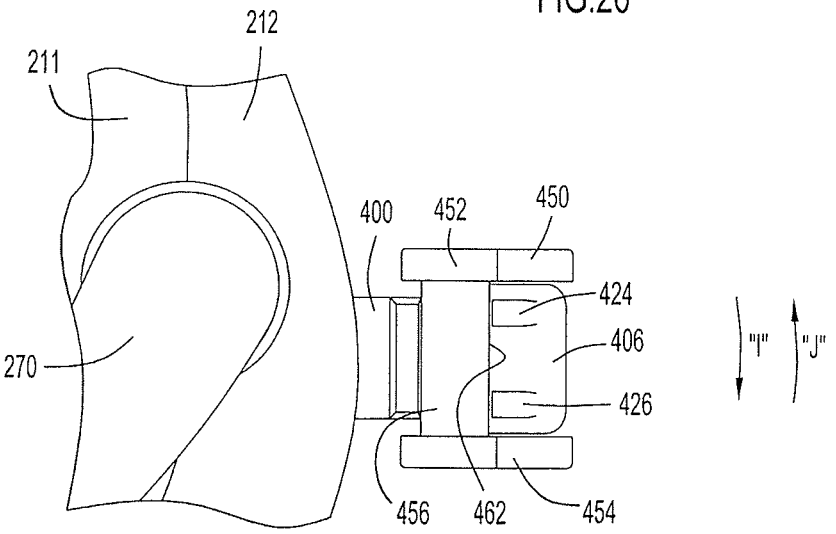
FIG. 27 illustrates a side view of some components of the doll shown in FIG. 18.

As shown in FIG. 27, a user can contact either of the plates 452 and 454 of the clip 450 to move the clip 450 and the lever 400. The clip 450 and outer end of the lever 400 can be moved along the direction of arrow "I" to raise the arms and the wings of the doll 200. The clip 450 and lever 400 can be moved along the direction of arrow "J" to lower the arms and the wings of the doll 200.

Figure 28:
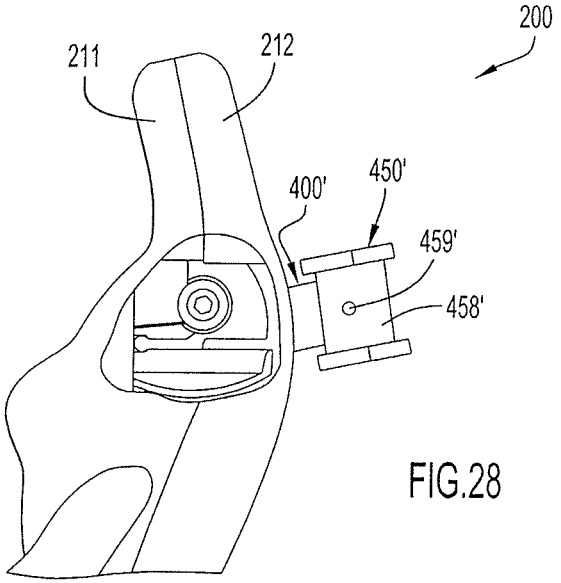
FIG. 28 illustrates a side view of some components of the doll shown in FIG. 18 in a dress configuration.
Figure 29:
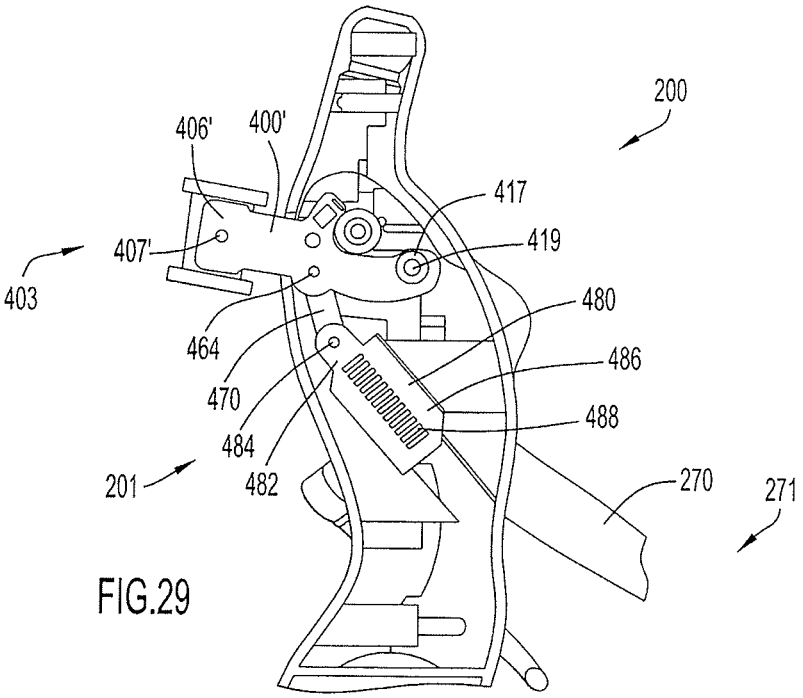
FIG. 29 illustrates an internal side view of some components of the doll shown in FIG. 28.

Referring FIGS. 28-29, some components of the doll 200 in its dress configuration or position are illustrated. The clip 450' illustrated in FIGS. 28-29 has a slightly different configuration than the clip 450 described above. Clip 450' has a receptacle into which the distal or outer end 406' of the lever 400', which is the substantially the same as lever 400, is inserted. The main difference is that the outer end 406' of the lever 400' has an opening 407' and the clip 450' has a support 458' that has an opening 459'. A connector can be inserted through the openings 407' and 459' to couple the clip 450' to the lever 400'.

In FIGS. 28 and 29, the lever 400' and the clip 450' are illustrated in their positions 403 corresponding to the dress configuration of the doll 200. As shown in FIG. 29, arm 270 of the doll 200 is in a lowered position 271 relative to the body of the doll 200. In FIG. 29, some of the components of the actuating assembly 201 of the doll 200 are illustrated. The lever 400' is pivotally mounted about shaft 417 that defines an axis 419 about which the lever 400' pivots.

The assembly 201 includes a link 470 that is coupled to the lever 400' via a connector inserted through hole 464 in the lever 400'. The connector facilitates movement of the link 470 relative to the lever 400' as the lever 400' pivots. The link 470 is coupled proximate to its other end to a rack 480. The rack 480 includes an upper end 482 with an opening 484 through which a connector can be inserted to couple the rack 480 to the lever 470. The rack 480 has opposite sides (only side 486 is illustrated) with teeth 488 that engage gears (not shown) that are coupled to the flipping or support members of the doll 200.

Figure 30:
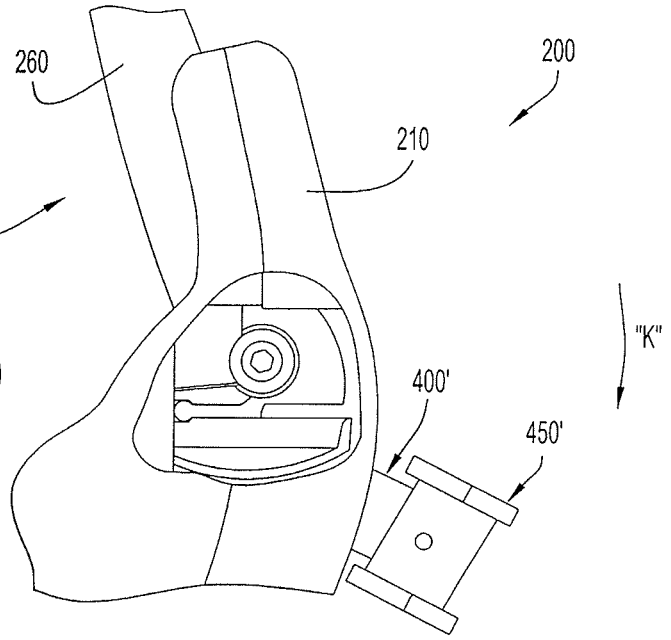
FIG. 30 illustrates a side view of some components of the doll shown in FIG. 18 in a wings configuration.

Referring to FIG. 30, the lever 400' and clip 450' can be moved along the direction of arrow "K" relative to the body 210. Such movement results in the arm 260 moving upwardly to its raised or upper position 263 relative to the body 210.

Figure 31:
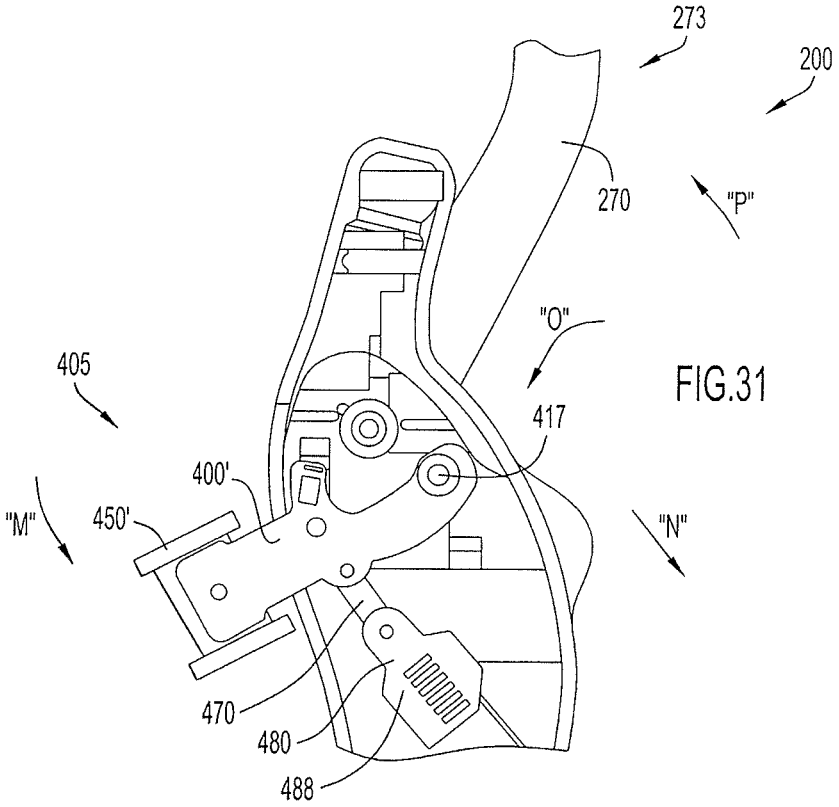
FIG. 31 illustrates an internal view of some components of the doll shown in FIG. 30.

Referring to FIG. 31, as the lever 400' and the clip 450' move along the direction of arrow "M" to their positions 405, the lever 400' pivots about axis 419 along the corresponding direction of arrow "O." The link 470 moves along the corresponding direction of arrow "N" and the arm 270 moves to its raised position 273.

Referring back to FIG. 18, as a user moves the clip 450 and the outer end of the lever 400 up and down, the lever 400 pivots about axis 700 along the appropriate direction of arrow "E" as defined by shaft 417. The link 470 is coupled to the lever 400 and moves in the corresponding direction of arrow "F." The rack 480 is coupled to the link 470 and is simultaneously moved via the link 470.

The lever 400 is also connected to coupler 500 which is a generally arcuate member with opposite ends 502 and 506 and teeth 504 along a surface proximate to end 502. The coupler 500 is slidably mounted for movement in the torso of the body 210. As the lever 400 moves, the coupler 500 moves as well. The teeth 504 of the coupler 500 are engaged with teeth 288 of gear 286 that is coupled to rotatably mounted shaft 280. When coupler 500 moves, the engagement of teeth 504 and teeth 288 cause the rotation of shaft 280 about axis 702 along the appropriate direction of arrow "G." The shaft 280 has opposite ends 282 and 284 that are connected to connectors 300 and 350. As the shaft 280 rotates, the arms 260 and 270 move via connectors 300 and 350.

Figure 32:
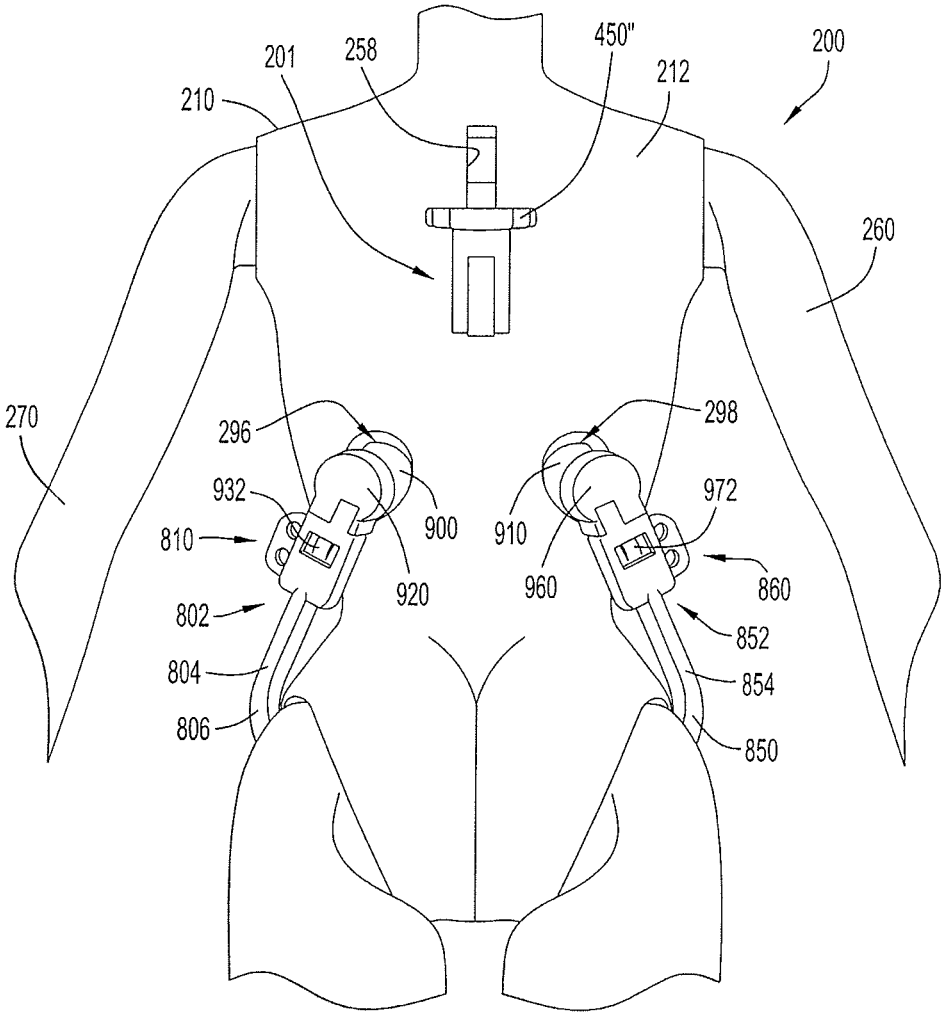
FIG. 32 illustrates a rear view of a portion of the doll shown in FIG. 18.
Figure 33:
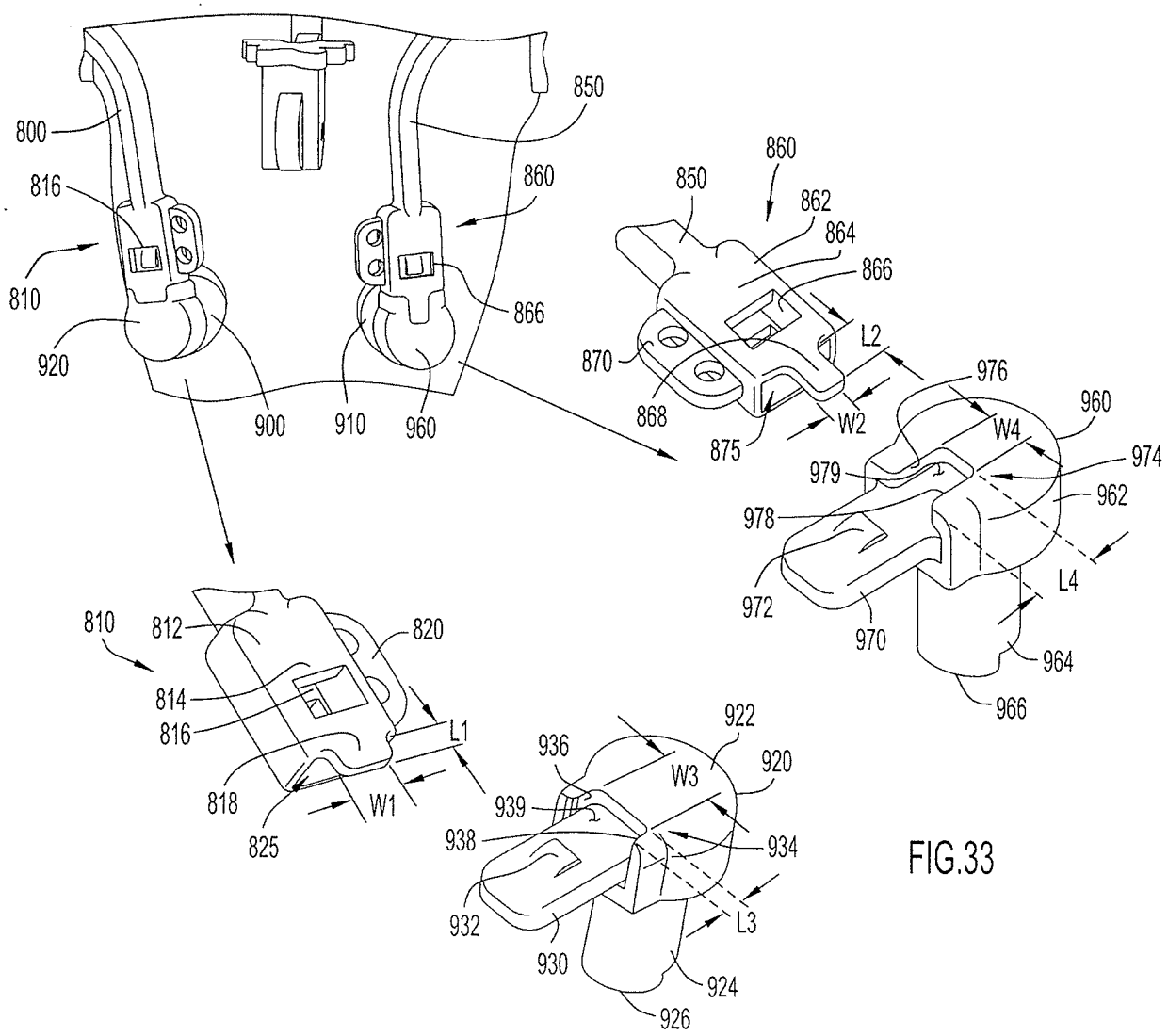
FIG. 33 illustrates exploded views of some components of the doll shown in FIG. 32.

Referring to FIGS. 32 and 33, an embodiment of doll 200 illustrating the connection of the flipping or support members is shown. In this embodiment, the doll 200 has a back section 212 to which part of the actuating assembly 201 is coupled. An alternative clip 450" is coupled to the lever 400 which is mounted for movement along slot 258 in back section 212. The doll 200 includes anus 260 and 270 which are pivotally coupled to the body 210.

Referring to FIG. 32, the doll 200 includes flipping or support members 800 and 850, which is illustrated in their lower or dress positions. The proximal end 802 and curved portion 804 of member 800 are illustrated. Similarly, the proximal end 852 and curved portion 854 of member 850 are illustrated. Member 800 is mounted to a coupler 920 which is connected to a mount 900. The mount 900 is part of a bevel gear that is driven by the rack of the drive or actuating assembly. As the bevel gear is rotated, the mount 900, the coupler 920, and the support member 800 rotate between the position illustrated in FIG. 32 and the upper or wing position illustrated in FIG. 33. Similarly, member 850 is mounted to a coupler 960 which is connected to a mount 910. The mount 910 is part of another bevel gear that is driven by the rack of the drive or actuating assembly. As this bevel gear is rotated, the mount 910, the coupler 960, and the support member 850 rotate between the positions illustrated in FIGS. 32 and 33.

Member 800 includes a coupling mechanism 810 that is used to mount the member 800 to coupler 920. Similarly, member 850 includes a coupling mechanism 860 that is used to mount the member 850 to coupler 960. Each of the members 800 and 850 is releasably coupled to its corresponding coupler 920 and 960.

Referring to FIG. 33, the details of coupling mechanisms 810 and 860 and couplers 920 and 960 are illustrated. Coupling mechanism 810 includes a housing 812 with several walls 814, one of which includes an edge defining an opening 816 extending through the wall. The housing 812 includes a tab 818 that extends outwardly from an end of the housing 812 and an extension that extends from a side of the housing 812. The walls of the housing 812 define a receptacle 825. The components of the coupling mechanism 810 can be integrally formed with the rest of the support member 800. In this embodiment, the tab 818 has a length dimension of L1 and a width dimension of W1.

Similarly, coupling mechanism 860 includes a housing 862 with several walls 864, one of which includes an edge defining an opening 866 extending through the wall. The housing 862 includes a tab 868 that extends outwardly from an end of the housing 862 and an extension that extends from a side of the housing 862. The walls of the housing 862 define a receptacle 875. The components of the coupling mechanism 860 can be integrally formed with the rest of the support member 850. Tab 868 has a length dimension of L2 and a width dimension of W2. In this embodiment, dimension L1 is different than dimension L2 and dimension W1 is different than dimension W2. In particular, dimension L1 is less than dimension L2 as tab 818 is shorter than tab 868 and dimension W1 is greater than dimension W2 as tab 818 is wider than tab 868. In an alternative embodiment, only one of the width and length dimensions may be different between the tabs.

Referring to FIG. 33, coupler 920 includes a body portion 922 with an extension 924 having a distal end 926. The extension 924 is inserted into an opening in mount 900 and retained therein by a friction fit. Alternatively, the extension 924 can be retained in the opening of the mount 900 using a detent and recess arrangement. The body portion 922 includes a tab 930 that extends outwardly from the body portion 922. The tab 930 includes a projection 932 formed thereon and an end 934 with sides 936 and 938 that collectively define a recess 939 with a length dimension L3 and a width dimension W3. In this embodiment, dimensions L3 and W3 of coupler 920 correspond to dimensions L1 and W1, respectively, of the coupling mechanism 810. Thus, when housing 812 is slid onto coupler 920 with the tab 930 inserted into the receptacle 825, the projection 932 engages opening 816 and the tab 818 fits in the recess 939.

Similarly, coupler 960 includes a body portion 962 with an extension 964 having a distal end 966. The extension 964 is inserted into an opening in mount 910 and retained therein by a friction fit. Alternatively, the extension 964 can be retained in the opening of the mount 910 using a detent and recess arrangement. The body portion 962 includes a tab 970 that extends outwardly from the body portion 962. The tab 970 includes a projection 972 formed thereon and an end 974 with sides 976 and 978 that collectively define a recess 979 with a length dimension L4 and a width dimension W4. In this embodiment, dimensions L4 and W4 of coupler 960 correspond to dimensions L2 and W2, respectively, of the coupling mechanism 860. Thus, when housing 862 is slid onto coupler 960 with the tab 970 inserted into the receptacle 875, the projection 972 engages opening 866 and the tab 868 fits in the recess 979.

The use of different sized tabs for coupling mechanisms 810 and 860 facilitates the proper assembly of the components of doll 200. In particular, a user will properly mount the support members 800 and 850 to the doll 200 due to the confirmation of parts fitting together only a certain way. If the support members 800 and 850 are improperly mounted or assembled, the reconfiguring or converting of the wings to a dress and back will not properly occur because the curved portions of the support members 800 and 850 are configured to wrap around part of the doll 200 in the dress configuration of the doll 200.

The connections between the coupling mechanisms 810 and 860 and the couplers 920 and 960 are press-fit connections so that the parts are releasably secured to each other and can be disconnected if needed. Each of the support members 800 and 850, the couplers 920 and 960, and the mounts 900 and 910 is formed of plastic.

Figure 34:
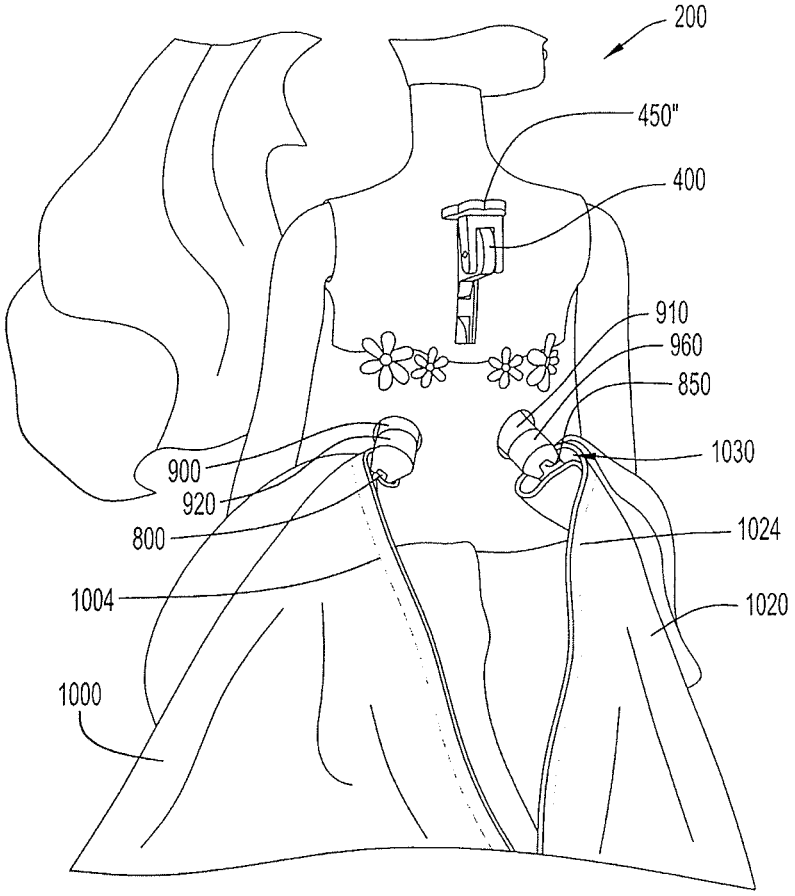
FIG. 34 illustrates a rear perspective view of an embodiment of a doll.
Figure 35:
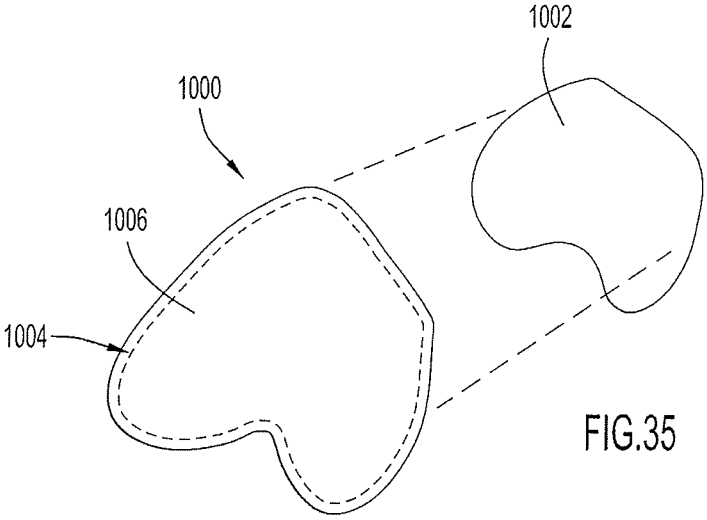
FIG. 35 illustrates an exploded perspective view of components of a wing for the doll shown in FIG. 34.

Referring to FIGS. 34 and 35, dress or wing portion 1000 is mounted to support member 800 and dress or wing portion 1020 is mounted to support member 850. In one embodiment, wing portion 1000 is formed using two layers 1002 and 1006 of material, such as layers of fabric that are coupled together by stitching 1004. The layers 1002 and 1006 have different ornamentation and decorations printed thereon or coupled thereto as illustrated. The layers 1002 and 1006 are coupled together to form a receptacle into which the support member 800 can be inserted and retained. Similarly, the dress or wing portion 1020 also includes stitching 1024 and multiple layers that form a receptacle 1030 into which support member 850 is inserted.

In one embodiment, the support members 800 and 850 have circular or substantially circular cross-sections so that they are rotatable within the receptacle of the corresponding dress or wing portion. Thus, as the support members 800 and 850 are rotated when a user manipulates the actuating assembly, the support members 800 and 850 slide and rotate within the movable portions 1000 and 1020 as the portions 1000 and 1020 move between dress and wing configurations of the doll 200.

In an alternative embodiment, the dress and wing portions may be formed of relatively stiff material. In another embodiment, each flipping or support member may be formed of multiple elements or components coupled together that facilitate the wrapping or curving around the torso of the doll by the support members.

While embodiments of a toy and methods of use have been shown and described, many variations may be made. This disclosure may include one or more independent or interdependent embodiments directed to various combinations of features, functions, elements and/or properties. Other combinations and sub-combinations are regarded as included within the subject matter of the present disclosure. Accordingly, the foregoing embodiments are illustrative, and no single feature or element, or combination thereof, is essential to all possible combinations that may be claimed in this or a later application. Each example defines an embodiment disclosed in the foregoing disclosure, but anyone example does not necessarily encompass all features or combinations that may be eventually claimed.

What is claimed is:

1. A reconfigurable doll, comprising:

a body including a torso and at least one arm movably coupled to the torso;

a movable portion coupled to the body, the movable portion being disposable in a first position proximate to the body in which the movable portion forms part of a dress for the body and in a second position spaced apart from the body in which the movable portion forms part of a wing for the body; and an actuator assembly coupled to the body, the actuator assembly being connected to the at least one arm and the movable portion, the actuator assembly being manipulatable by a user to move the movable portion from the first position to the second position and the at least one arm relative to the torso.

2. The reconfigurable doll of claim 1, wherein the body includes a lower portion and the movable portion in its first position is proximate to the lower portion of the body.

3. The reconfigurable doll of claim 1, wherein the at least one arm is movable substantially simultaneously with the movable portion.

4. The reconfigurable doll of claim 3, wherein the at least one arm has an upper position and a lower position relative to the body, the at least one arm extending upwardly from the body in its upper position and being located proximate to the body in its lower position.

5. The reconfigurable doll of claim 1, wherein the movable portion is a first movable portion and the doll further comprises:

a second movable portion coupled to the body, the second movable portion being disposable in its own first position proximate to the body in which the second movable portion forms part of the dress for the body and its own second position spaced apart from the body in which the second movable portion forms part of a wing for the body.

6. The reconfigurable doll of claim 5, wherein the second movable portion is moved substantially simultaneously with the first movable portion.

7. The reconfigurable doll of claim 5, wherein the first movable portion overlaps part of the second movable portion when the movable portions are in their first positions.

8. The reconfigurable doll of claim 5, wherein each of the movable portions includes a support member with a proximal end coupled to the torso and an opposite, distal end, the distal ends of the support members crossing over each other when the movable portions are moved from their second positions to their first positions.

9. The reconfigurable doll of claim 1, wherein the actuator assembly includes an actuator extending outwardly from the body, the actuator being manipulatable by a user to move the movable portion.

10. The reconfigurable doll of claim 1, wherein the movable portion includes a support member that is pivotally coupled to the torso of the doll and a flexible member that is coupled to the support member.

11. The reconfigurable doll of claim 10, wherein the support member includes a proximal end, a distal end, and a curved portion between the proximal end and the distal end, the proximal end being coupled to the body.

12. The reconfigurable doll of claim 11, wherein the distal end extends outwardly away from the body when the movable portion is in its second position, and the curved portion extends around part of the torso of the body when the movable portion is in its first position.

13. A reconfigurable doll, comprising:

a body including a torso and a lower portion;

a movable member coupled to the body, the movable member being disposable in an upper position and in a lower position relative to the body, the movable member being spaced from the body and forming a wing-like structure in its upper position, the movable member being located proximate to the lower portion of the body and forming a dress-like structure in its lower position; and an actuator assembly coupled to the body, the actuator assembly being connected to the movable member in the torso of the body so that a user can manipulate the actuator assembly to move the movable member between its upper position and its lower position.

14. The reconfigurable doll of claim 13, wherein the movable member is a first movable member, the doll further comprising:

a second movable member coupled to the body and to the actuator assembly, the movable members collectively forming a dress when the movable members are in their lower positions and collectively forming a pair of wings when the movable members are in their upper positions, the movable members being moved substantially simultaneously between their upper positions and lower positions via the actuator assembly.

15. The reconfigurable doll of claim 14, wherein the body includes a first arm and a second arm movably coupled to the torso, the actuator assembly being connected to the first arm and second arm so that a user can manipulate the first arm and second arm relative to the body substantially simultaneously when the first and second movable members are moved.

16. The reconfigurable doll of claim 15, wherein the arms are moved from lower positions to upper positions substantially simultaneously when the movable members are moved from their lower positions to their upper positions.

17. The reconfigurable doll of claim 16, wherein the actuator assembly includes an actuator and a drive mechanism coupled to the actuator, the drive mechanism being connected to the arms and to the movable members so that movement of the actuator results in movement of the arms and movable members relative to the body.

18. The reconfigurable doll of claim 13, wherein the body includes a first arm and a second arm movably coupled to the torso, and the actuator assembly is connected to the first arm and second arm so that a user can manipulate the first arm and second arm relative to the body when the movable member is moved.

19. A reconfigurable doll, comprising:

a body including a torso, a lower portion, and arms movably coupled to the torso, the arms being disposable in raised positions and in lowered positions relative to the body;

movable members coupled to the body, the movable members being placeable in raised positions and in lowered positions relative to the body, the movable members being spaced from the body and forming a wing-like structure in their raised positions, the movable members being located proximate to the lower portion of the body and forming a dress-like structure in their lowered positions; and an actuator coupled to the arms and the movable members, the actuator being configured to move the movable members between their raised and lowered positions substantially simultaneously with the movement of the arms between their raised and lowered positions.

20. The reconfigurable doll of claim 19, wherein each of the movable members includes a support member pivotally coupled to the body, the support members extending outwardly from the torso when the movable members are in their raised positions, the support members being located proximate to the lower portion of the body when the movable members are in their lowered positions, the support members crossing over each other when the movable members are in their lowered positions.

* * * * *

UNITED STATES PATENT AND TRADEMARK OFFICE

CERTIFICATE OF CORRECTION

PATENT NO. : 9,168,462 B2
APPLICATION NO. : 12/577173
DATED : October 27, 2015
INVENTOR(S) : Simon Jung It is certified that error appears in the above-identified patent and that said Letters Patent is hereby corrected as shown below:

Specification

Column 5, line 42, replace “foamed” with --formed--;

Column 12, line 2, replace “aim” with --arm--;

Column 13, line 59, change “anus” to --arms--.

Signed and Sealed this
Third Day of May, 2016

Michelle K. Lee

Michelle K. Lee
*Director of the United States Patent and Trademark Office*